US009038549B1

(12) United States Patent
Zebarjad

(10) Patent No.: US 9,038,549 B1
(45) Date of Patent: May 26, 2015

(54) HEIGHT ADJUSTABLE TABLE

(71) Applicant: Humanscale Corporation, New York, NY (US)

(72) Inventor: Hamid Zebarjad, New York, NY (US)

(73) Assignee: Humanscale Corporation, New York, NY (US)

( * ) Notice: Subject to any disclaimer, the term of this patent is extended or adjusted under 35 U.S.C. 154(b) by 0 days.

(21) Appl. No.: 13/827,333

(22) Filed: Mar. 14, 2013

Related U.S. Application Data

(60) Provisional application No. 61/654,609, filed on Jun. 1, 2012.

(51) Int. Cl.
*A47B 9/20* (2006.01)
*A47B 13/08* (2006.01)
*A47B 9/02* (2006.01)

(52) U.S. Cl.
CPC . *A47B 9/20* (2013.01); *A47B 13/08* (2013.01); *A47B 9/02* (2013.01)

(58) Field of Classification Search
CPC ..... A47B 9/00; A47B 9/02; A47B 9/12; A47B 21/02
USPC ..... 108/37, 33, 144.11, 147, 147.19, 136; 248/188.2, 161, 404, 157, 162.1, 248/123.11, 122.2
See application file for complete search history.

(56) References Cited

U.S. PATENT DOCUMENTS 3,575,368 A 4/1971 Thomas et al.
3,890,907 A 6/1975 Peterson
4,351,245 A * 9/1982 Laporte ..... 108/136
4,714,028 A 12/1987 Uredat-Neuhoff
4,949,650 A 8/1990 Allard
5,174,223 A 12/1992 Nagy et al.
5,311,827 A * 5/1994 Greene ..... 108/147
5,718,406 A 2/1998 Long (Continued)

FOREIGN PATENT DOCUMENTS

AU 2009218798 A1 9/2009
CN 101965140 A 2/2011

(Continued)

OTHER PUBLICATIONS

Teknion Corporation, Teknion Tables, Quick Shift online brochure, May 3, 2007, 8 pages.

(Continued)

*Primary Examiner* — Daniel Rohrhoff

(74) *Attorney, Agent, or Firm* — Jones Walker LLP

(57) ABSTRACT

A height adjustable table, which has a constant-force counterbalance mechanism integrated into a top assembly of the table is disclosed. The height adjustable table can include a top assembly supported by a base assembly, which can include right and left telescoping leg assemblies. The top assembly can include a work surface supported by a housing. A counterbalance mechanism, which can include a spring coupled to a snail cam pulley, can be mounted within the housing. A synchronized lift mechanism, which can include at least two bands operatively engaged with a pulley system disposed within the right and left telescoping leg assemblies, can be operatively coupled to the snail cam pulley such that the counterbalance force provided by the counterbalance mechanism is transmitted to the synchronized lift mechanism.

16 Claims, 22 Drawing Sheets

(56) References Cited

U.S. PATENT DOCUMENTS

| | | | | |
|---|---|---|---|---|
| 5,722,331 | A * | 3/1998 | Machael | 108/145 |
| 6,026,755 | A | 2/2000 | Long | |
| 6,062,148 | A * | 5/2000 | Hodge et al. | 108/147 |
| 6,289,825 | B1 | 9/2001 | Long | |
| 6,374,752 | B1 | 4/2002 | Walser | |
| 6,378,446 | B1 * | 4/2002 | Long | 108/147 |
| 6,418,860 | B1 | 7/2002 | Hinderhofer | |
| 6,474,243 | B1 | 11/2002 | Grohse | |
| 6,484,648 | B1 | 11/2002 | Long | |
| 6,546,880 | B2 * | 4/2003 | Agee | 108/147 |
| 6,584,917 | B2 * | 7/2003 | Long | 108/147 |
| 7,559,516 | B2 | 7/2009 | Koder | |
| 7,658,359 | B2 | 2/2010 | Jones et al. | |
| 7,866,268 | B2 | 1/2011 | Nagel et al. | |
| 8,091,841 | B2 * | 1/2012 | Jones et al. | 248/125.2 |
| 8,201,505 | B2 * | 6/2012 | Long | 108/147 |
| 8,240,257 | B2 * | 8/2012 | Frost | 108/20 |
| 2005/0002591 | A1 | 1/2005 | Buitmann | |
| 2006/0061942 | A1 | 3/2006 | Abel et al. | |
| 2010/0176254 | A1 | 7/2010 | Sweere et al. | |
| 2010/0193653 | A1 | 8/2010 | Sweere et al. | |
| 2011/0048291 | A1 * | 3/2011 | Long | 108/147 |
| 2011/0198975 | A1 | 8/2011 | Barkau et al. | |

FOREIGN PATENT DOCUMENTS

| | | | |
|---|---|---|---|
| DE | 102008010768 | A1 | 8/2009 |
| EP | 1987734 | B1 | 12/2010 |
| EP | 2254440 | | 12/2010 |
| WO | 0174197 | A1 | 10/2001 |
| WO | 2009106292 | A1 | 9/2009 |
| WO | 2011025561 | A1 | 3/2011 |

OTHER PUBLICATIONS

Steelcase, Inc., Airtouch online brochure, Feb. 2, 2011, 5 pages.
Ki, WorkUp Adjustable Table online brochure, Mar. 19, 2012, 4 pages.
Global Upholstery Co., Inc., Height Adjustable Tables online brochure, Jan. 26, 2001, 2 pages.

* cited by examiner

HEIGHT ADJUSTABLE TABLE

CROSS-REFERENCE TO RELATED APPLICATION

This application claims the benefit of U.S. Provisional Application No. 61/654,609, filed Jun. 1, 2012, which is hereby incorporated by reference.

BACKGROUND OF THE INVENTION

Recent research shows sedentary work increases the risk of cancer and heart disease regardless of other health indicators such as exercise and nutrition. However, standing all day in a static position can also cause health problems, including a significant increase in the risk of carotid atherosclerosis. The healthiest workplace solution allows users to alternate between sitting and standing positions throughout the day.

Height adjustable tables have been developed to allow a user to change posture from a seated to a standing position throughout the day. Height adjustable tables are ideally construed to have task specific heights that are ergonomically correct. An ergonomically correct position is one where the height of the work surface of a table is at the user's elbows and where the height of the work surface provides adequate leg room and knee space allowing a user to feel uncrowded and to allow for some changes of position. Existing height adjustable tables typically utilize either a hand crank, an electric motor, or a counterbalance mechanism to adjust the height of the work surface.

Counterbalance adjustable tables, which utilize either a counterweight or a spring to offset the load on the work surface, are advantageous over hand crank tables and electric tables since the height of the work surface can be effortlessly adjusted without consuming electricity. However, the counterbalance assemblies are typically disposed either within the table's leg(s) or within a cross-member beam extending between table's legs. For instance, U.S. Pat. No. 7,658,359 discloses a single leg counterbalance table having a compression spring disposed within a pedestal-type support leg extending below the work surface. Meanwhile, U.S. Pat. No. 5,706,739 discloses a multi-leg counterbalance table having a torsion spring disposed within a cross-member beam extending between the table's legs. Disadvantageously, both arrangements cause the table's support structure to be bulky, thereby reducing leg room below the work surface.

Previous attempts have been made to develop a height adjustable table, having a less bulky counterbalance mechanism, which does not restrict leg room below the work surface. For instance, another known height adjustable table features a counterbalance mechanism comprising gas springs disposed within opposing table legs, with each gas spring designed to provide a preset counterbalance force. While such a table provides for more leg room by eliminating the bulky cross-member beam, the counterbalance mechanism does not accommodate for varying loads. If the load on the work surface exceeds the counterbalance force, adjustment of the table's work surface may require the user to exert an excessive amount of force. Conversely, if the counterbalance force exceeds the applied load, the work surface may surprisingly move rapidly and thus present a safety hazard.

SUMMARY OF THE INVENTION

The invention disclosed herein is directed to a height adjustable table having a constant-force counterbalance mechanism integrated into the top assembly of the table. In a particular embodiment exemplifying the principles of the invention, the height adjustable table can comprise a top assembly supported by a base assembly. The base assembly can comprise first and second telescoping leg assemblies, with each leg assembly having outside and inside legs featuring a variable overlap to accommodate height adjustment of the top assembly. The top assembly can comprise a work surface supported by a housing. The counterbalance mechanism, which can comprise a tension spring coupled to a snail cam pulley by a snail cable, can be mounted within the housing.

The height adjustable table of the present invention can also feature a synchronized lift mechanism. The synchronized lift mechanism can comprise at least two bands operatively engaged with a pulley system disposed within the right and left telescoping leg assemblies. The pulley system can comprise first and second pulley assemblies each having an upper pulley and a lower pulley, with the upper pulley being mounted to the top of the respective telescoping leg assembly and the lower pulley being mounted to the end of a shaft suspended within the internal cavity of the respective telescoping leg assembly. The first end of the first band is connected to the inside leg of the second telescoping leg assembly and extends around the upper pulley of the second pulley assembly, across the housing, around the upper pulley of the first pulley assembly, around the lower pulley of the first pulley assembly, and connects at a second end to the inside leg of the first telescoping leg assembly. The first end of the second band is connected to the inside leg of the first telescoping leg assembly and extends around the at least one upper pulley of the first pulley assembly, across the housing, around the at least one upper pulley of the second pulley assembly, around the at least one lower pulley of the second pulley assembly, and connects at a second end to the inside leg of the second telescoping leg assembly.

The synchronized lift mechanism be operatively coupled to the counterbalance mechanism by a lift cable. The lift cable snail cam pulley by a lift cable. The lift cable can be attached to the lift track of the snail cam wheel on one end and attached to the inside leg of at least one of the first and second telescoping leg assemblies at the other end. In this arrangement, the counterbalance force provided by the counterbalance mechanism will be transmitted to the synchronized lift mechanism.

In certain embodiments, a preload mechanism can be coupled to the counterbalance mechanism to provide a means for preloading the tension spring. The preload mechanism of the present invention allows the counter-weighting force to be easily adjusted by users to match the load (i.e., it is load-variable), thereby eliminating the safety risk associated with non-load variable counterbalance tables while also providing a work surface that can be moved up and down with minimal effort. The height adjustable table may also optionally include a lock mechanism for selectively preventing height adjustment of the table.

The above summary is not intended to describe each illustrated embodiment or every possible implementation. These and other features, aspects, and advantages of the present invention will become better understood with regard to the following description, appended claims, and accompanying drawings.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages in accordance with the present invention.

DETAILED DESCRIPTION OF THE INVENTION

Figure 1:
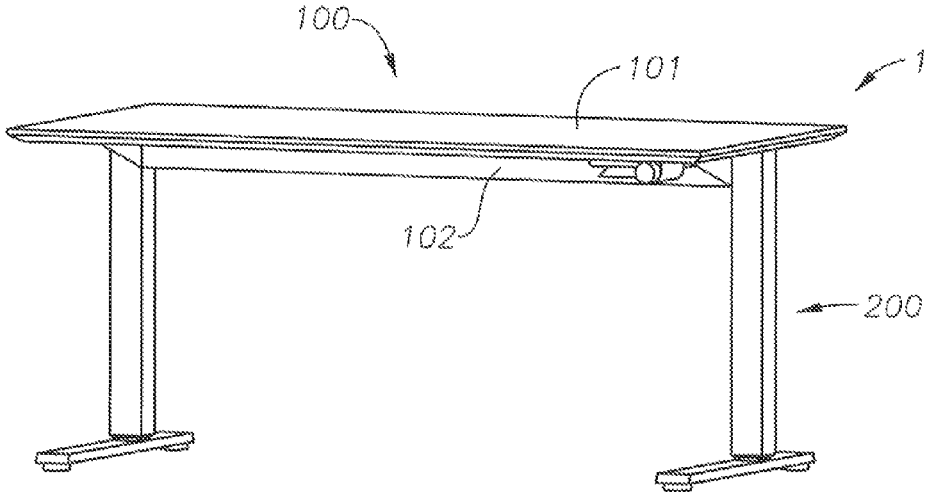
FIG. 1 is a front perspective view of an embodiment of a height adjustable table exemplifying the principles of the present invention wherein the table is in the lowered position.
Figure 2:
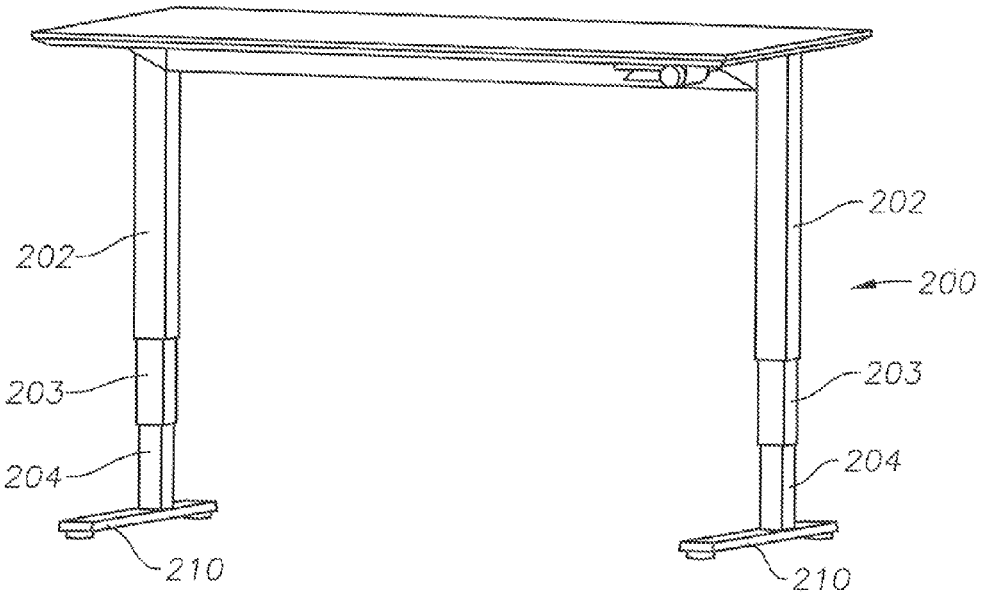
FIG. 2 is a front perspective view of the embodiment of the height adjustable table shown in FIG. 1 wherein the table is in the raised position.
Figure 3:
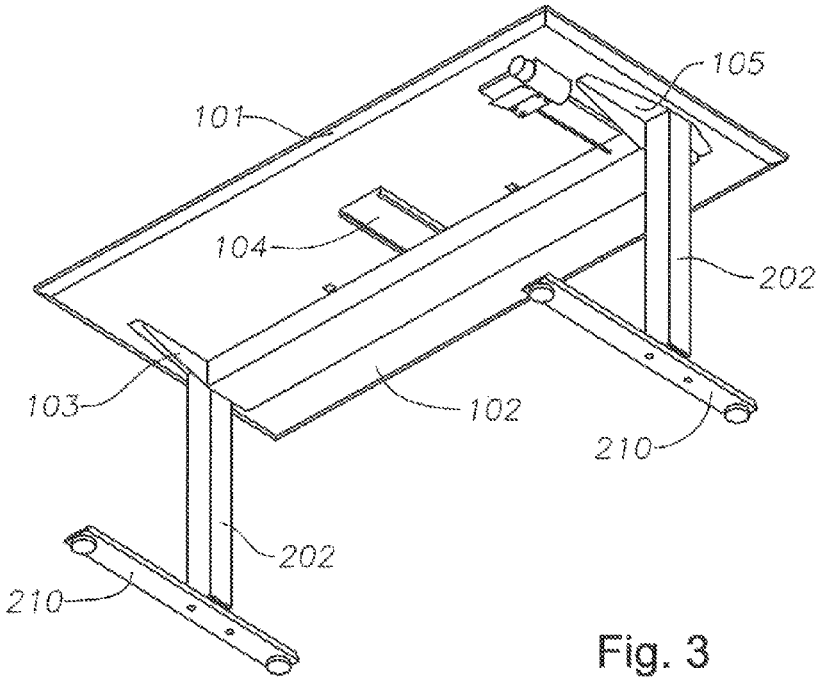
FIG. 3 is a bottom perspective view of the embodiment of the height adjustable table shown in FIG. 1 wherein the table is in the lowered position.
Figure 4:
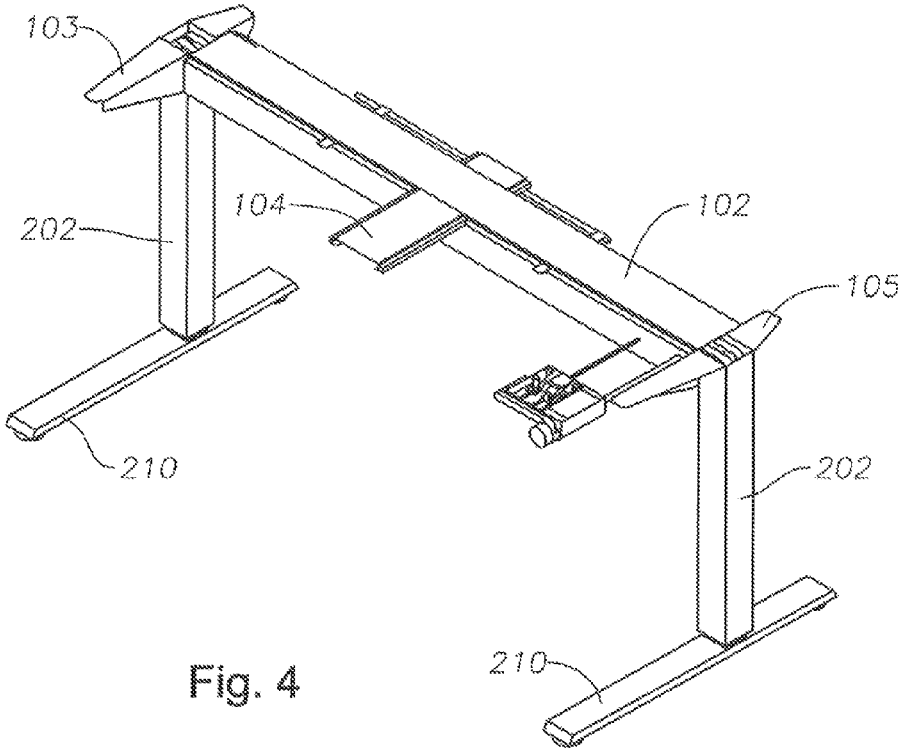
FIG. 4 is a top perspective view of the embodiment of the height adjustable table shown in FIG. 1 wherein the work surface is removed.
Figure 5:
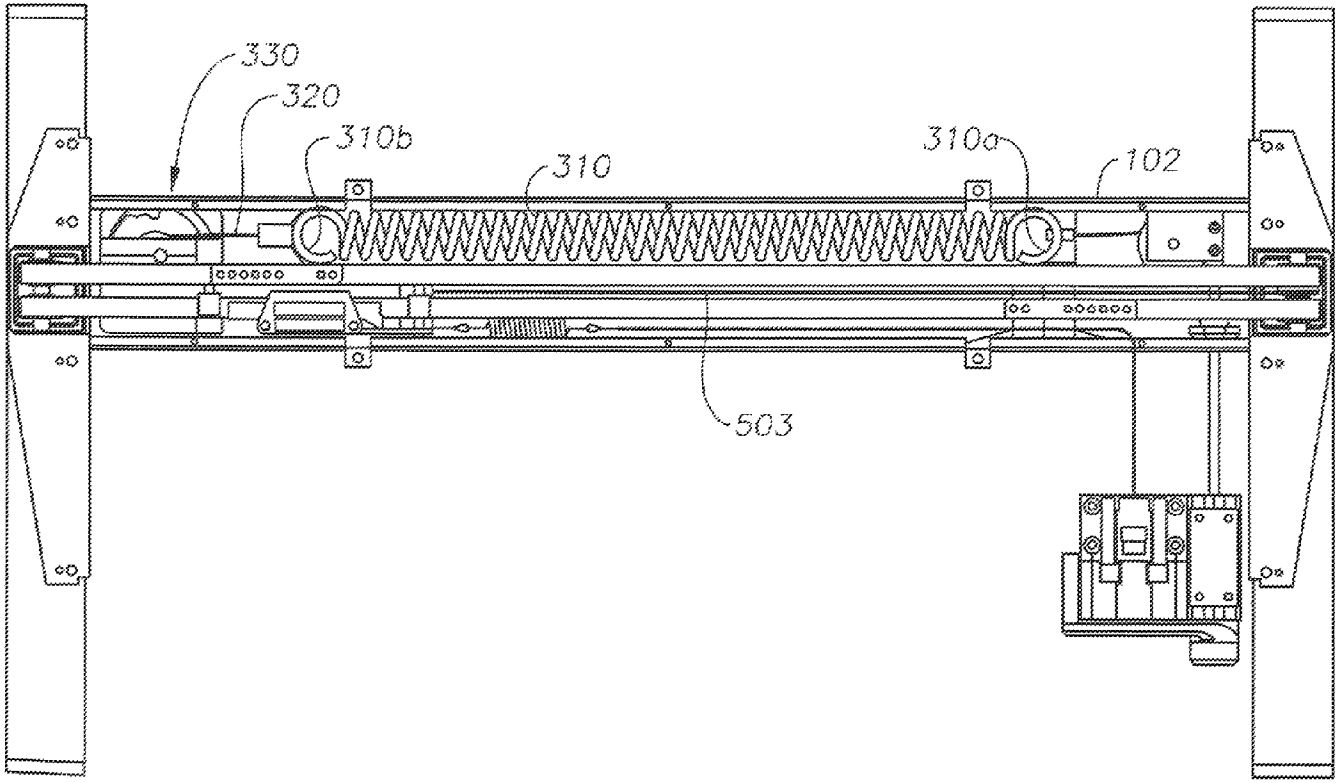
FIG. 5 is a top view of the embodiment of the height adjustable table shown in FIG. 1 wherein the top of the housing is removed to reveal embodiments of the constant-force counterbalance mechanism, synchronized lift mechanism, preload mechanism, and lock mechanism of the present invention.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Alternate embodiments may be devised without departing from the spirit or the scope of the invention. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

As used herein, the terms "a" or "an" are defined as one or more than one. The term "plurality," as used herein, is defined as two or more than two. The term "another," as used herein, is defined as at least a second or more. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including," "having," or "featuring," as used herein, are defined as comprising (i.e., open language). The term "coupled," as used herein, is defined as connected, although not necessarily directly, and not necessarily mechanically. As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Relational terms such as first and second, top and bottom, right and left, and the like may be used solely to distinguish one entity or action from another entity or action without necessarily requiring or implying any actual such relationship or order between such entities or actions.

Herein various embodiments of the present invention are described. To avoid redundancy, repetitive description of similar features may not be made in some circumstances. Furthermore, certain views of the embodiments of the present invention are duplicated (e.g., FIGS. 5, 9, 15, and 21) for ease of understanding the various mechanisms employed by the present invention.

Prior art counterbalance tables typically have their counterbalance mechanism disposed either within the table's leg (s) or within a cross-member beam extending between table's legs. Disadvantageously, such arrangements either cause the table's base to be bulky and thus reduces leg room below the work surface, or result in a table which is not capable of accommodating varying loads. The present invention addresses these problems by integrating a load-variable counterbalance mechanism into the top assembly.

A height adjustable table embodying the principles of the present invention is depicted in FIGS. 1-24. Referring to FIGS. 1-4, the height adjustable table 1 can comprise a top assembly 100 supported by a base assembly 200. The top assembly 100 includes a planar work surface 101 mounted to a housing 102. The housing 102 can feature plates 103, 104, 105 for stabilizing the work surface 101 on the housing 102.

The base assembly 200 can comprise right and left telescoping leg assemblies, with each leg assembly having an outside leg 202, a middle leg 203, an inside leg 204, and a foot 210. The legs 202, 203, 204 have a variable overlap to accommodate height adjustment of the work surface 101. The outside leg 202 is attached to the top assembly 100 and thereby moves with the work surface 101 as it is raised and lowered. The inside leg 204 is attached to the foot 210 and remains stationary as the work surface 101 is raised and lowered. The right and left leg assemblies optionally can comprise a roller cage 540 (See FIG. 10) containing a plurality of rollers for facilitating frictionless sliding of the legs 202, 203, 204 as the work surface 101 is raised and lowered. In alternative embodiments, the inside leg 204 can be attached to the top assembly 100 and the outside leg 202 can be attached to the foot 210. In such alternative embodiments, the inside leg 204 will move with the work surface 101 as it is raised and lowered, while the outside leg 202 will remain stationary. In other alternative embodiments, the right and left leg assemblies can comprise only an outside leg 202 and an inside leg 204, thus disposing of the middle leg 203; or more than one middle leg 203 may be disposed between the outside leg 202 and the inside leg 204.

Referring to FIGS. 5-8B, the height adjustable table 1 of the present invention features a constant-force counterbalance mechanism disposed within the housing 102. In most applications, it is desirous for a height adjustable table's counterbalance mechanism to provide a constant counterweighting force to offset the constant load on the work surface 101. The counterbalance mechanism of the present invention utilizes a tension spring 310 to provide the counterweighting force. However, it is well known that the force exerted, for example, by a typical tension spring varies linearly with its extension. To offset the linearly increasing force exerted by the tension spring 310, the counterbalance mechanism of the present invention employs a snail cam pulley 330, which operates in conjunction with the tension spring 310 to provide a relatively constant counter-weighting force.

Figure 7:
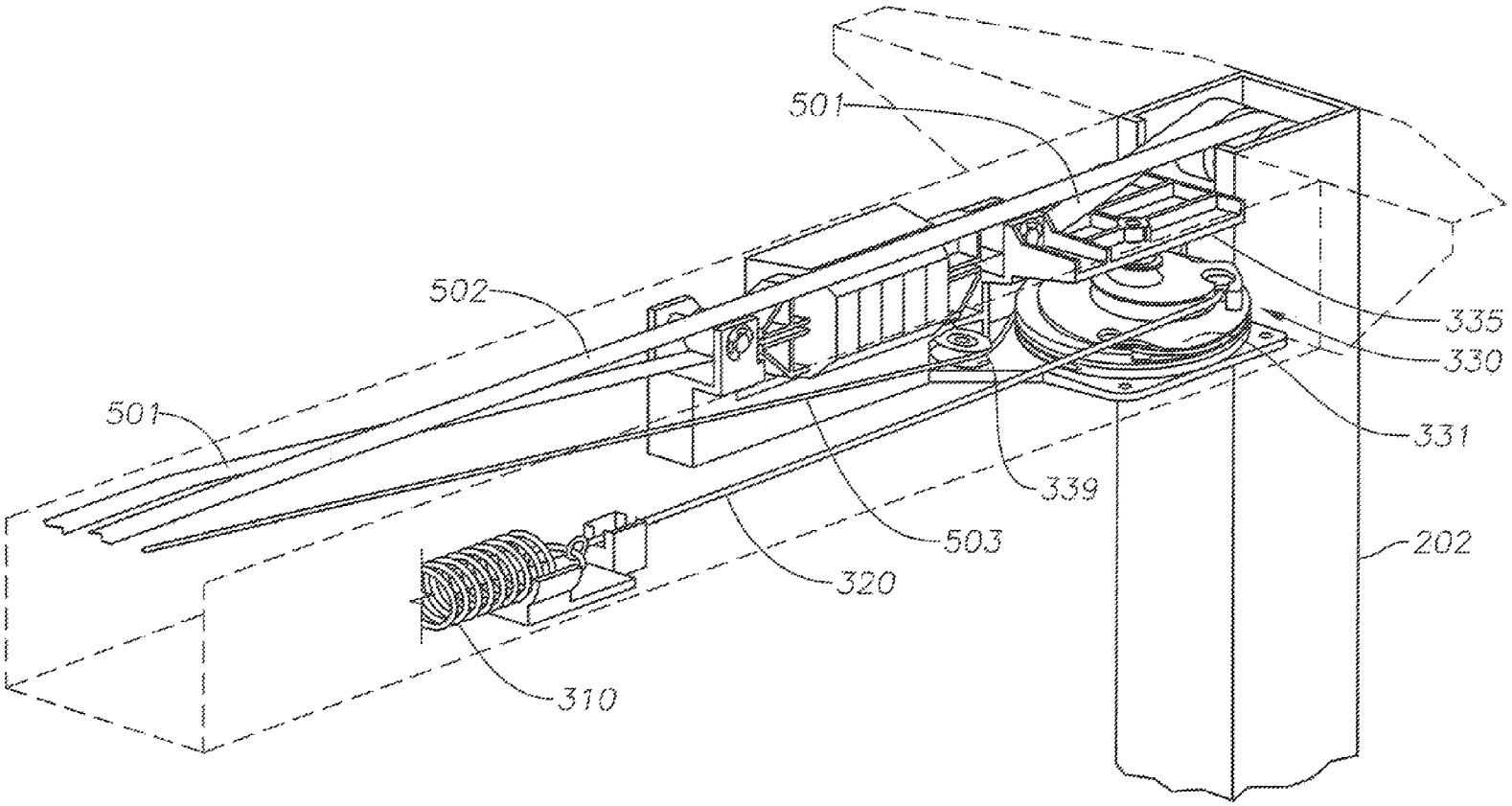
FIG. 7 is a partial rear perspective view of the embodiment of the height adjustable table shown in FIG. 1 showing the interconnectivity of the constant-force counterbalance mechanism, the synchronized lift mechanism, and the lock mechanism.
Figure 8A:
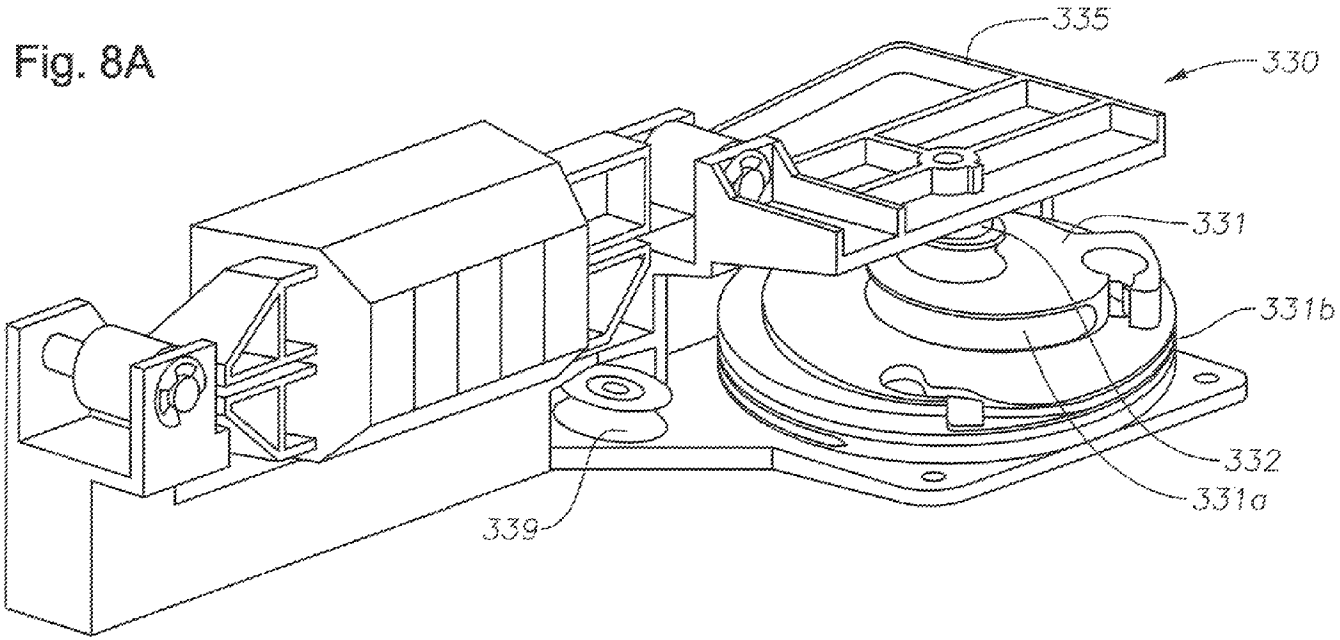
FIG. 8A is a perspective view of an embodiment of the snail cam pulley of the present invention.
Figure 8B:
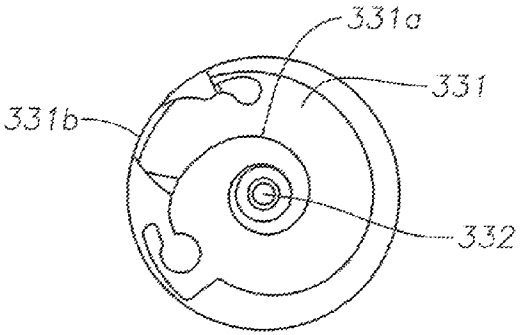
FIG. 8B is a top view of an embodiment of the snail cam wheel of the present invention.

As best illustrated in FIGS. 8A-B, the snail cam pulley 330 comprises a snail cam wheel 331 secured to a mount 335 by an axle 332, with the axle 332 defining an axis of rotation for the snail cam wheel 331. The snail cam wheel 331 features a cam track 331*a* and a lift track 331*b*. The cam track 331*a* has a variable radius relative to the axis of rotation of the cam wheel 331. A snail cable 320 (FIGS. 5-7), which is preferably constructed out of nylon or another synthetic polymer, connects the second end 310*b* of the tension spring 310 to the cam track 331*a* of the snail cam wheel 331, while a lift cable 503 (FIGS. 5-7) connects a synchronized lift mechanism (discussed below) of the table 1 to the lift track 331*b* of the snail cam wheel 331. The cam track 331*a* functions as a variable lever arm by which the spring force is applied to the snail cam wheel 331. As the snail cam wheel 331 rotates counterclockwise (from the top view perspective depicted in FIG. 8B), the effective lever arm decreases. In this arrangement, the linearly increasing force provided by the tension spring 310 is converted to a relatively constant force as the snail cam wheel 331 rotates counterclockwise and the snail cable 320 wraps around the cam track 331*a*.

The height adjustable table 1 of the present invention, as indicated above, also features a synchronized lift mechanism that allows for single-handed, level height adjustment of the work surface 101 regardless of whether the adjustment force is applied to the middle, right side, or left side of the top assembly 100. An embodiment of the synchronized lift mechanism is depicted in FIGS. 9-14. The synchronized lift mechanism comprises first and second bands 501, 502, which interact with a pulley system positioned within the base assembly 200 to provide synchronized lifting or lowering of the top assembly 100.

An exemplary pulley system comprises right and left pulley assemblies positioned within the right and left telescoping leg assemblies. The right pulley assembly comprises a first upper pulley 511, a second upper pulley 512, and an upper lift cable pulley 513 each mounted to an axle 526 that is secured to the outside leg 202 of the right telescoping leg assembly. A lower pulley 514 and a lower lift cable pulley 515 are connected to the first upper pulley 511 by a right shaft 504 that is suspended within the internal cavity of the outside, middle, and inside legs 202, 203, 204 of the right telescoping leg assembly. Similarly, the left pulley assembly comprises a first upper pulley 517 and a second upper pulley 518 each mounted to an axle 527 that is secured to the outside leg 202 of the left telescoping leg assembly. A lower pulley 519 is connected to the second upper pulley 518 by a left shaft 505, which is suspended within the internal cavity of the outside, middle, and inside legs 202, 203, 204 of the left telescoping leg assembly.

Figure 11:
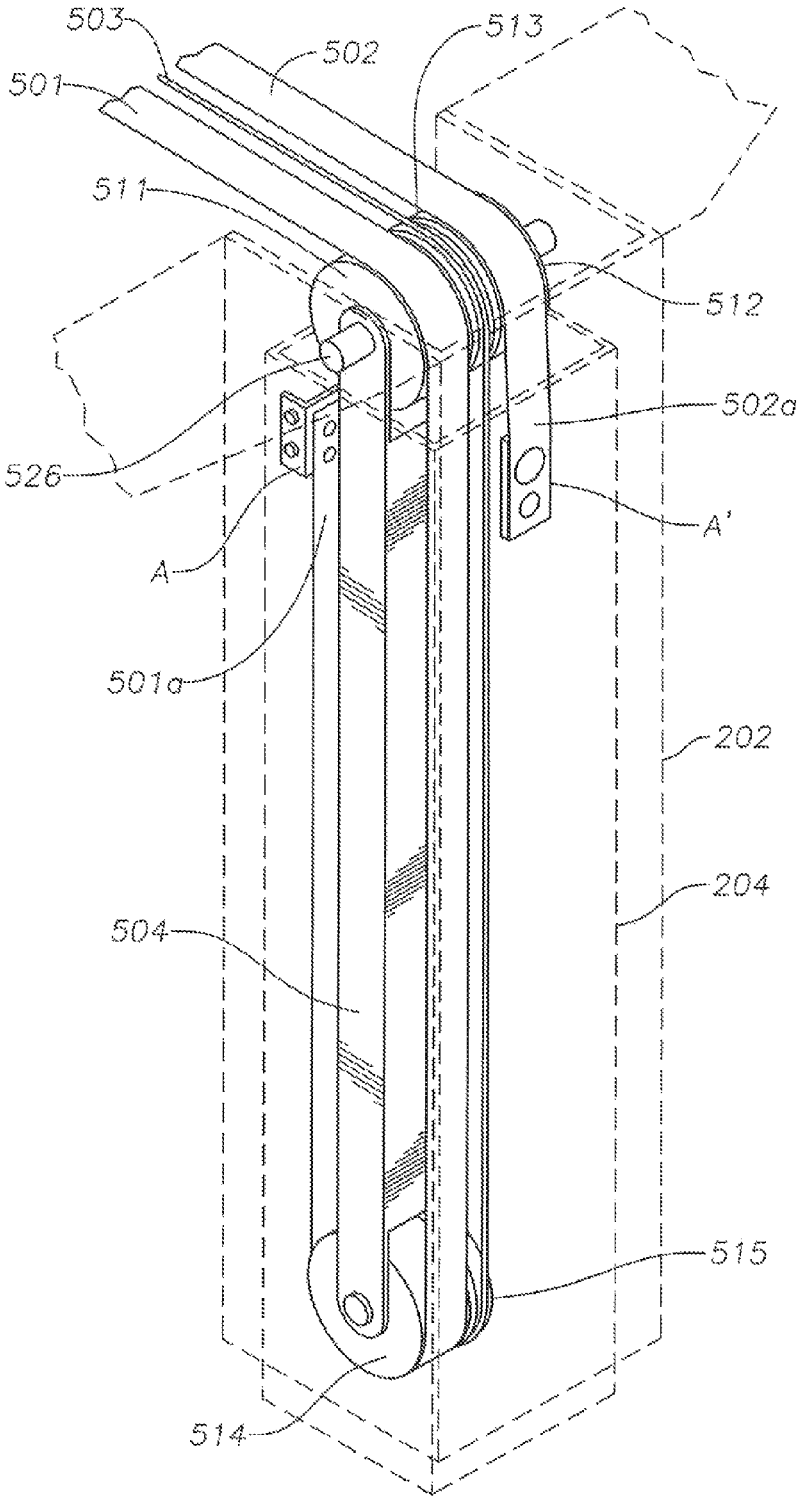
FIG. 11 is a partial perspective view of an embodiment of the height adjustable table's right leg assembly.
Figure 12:
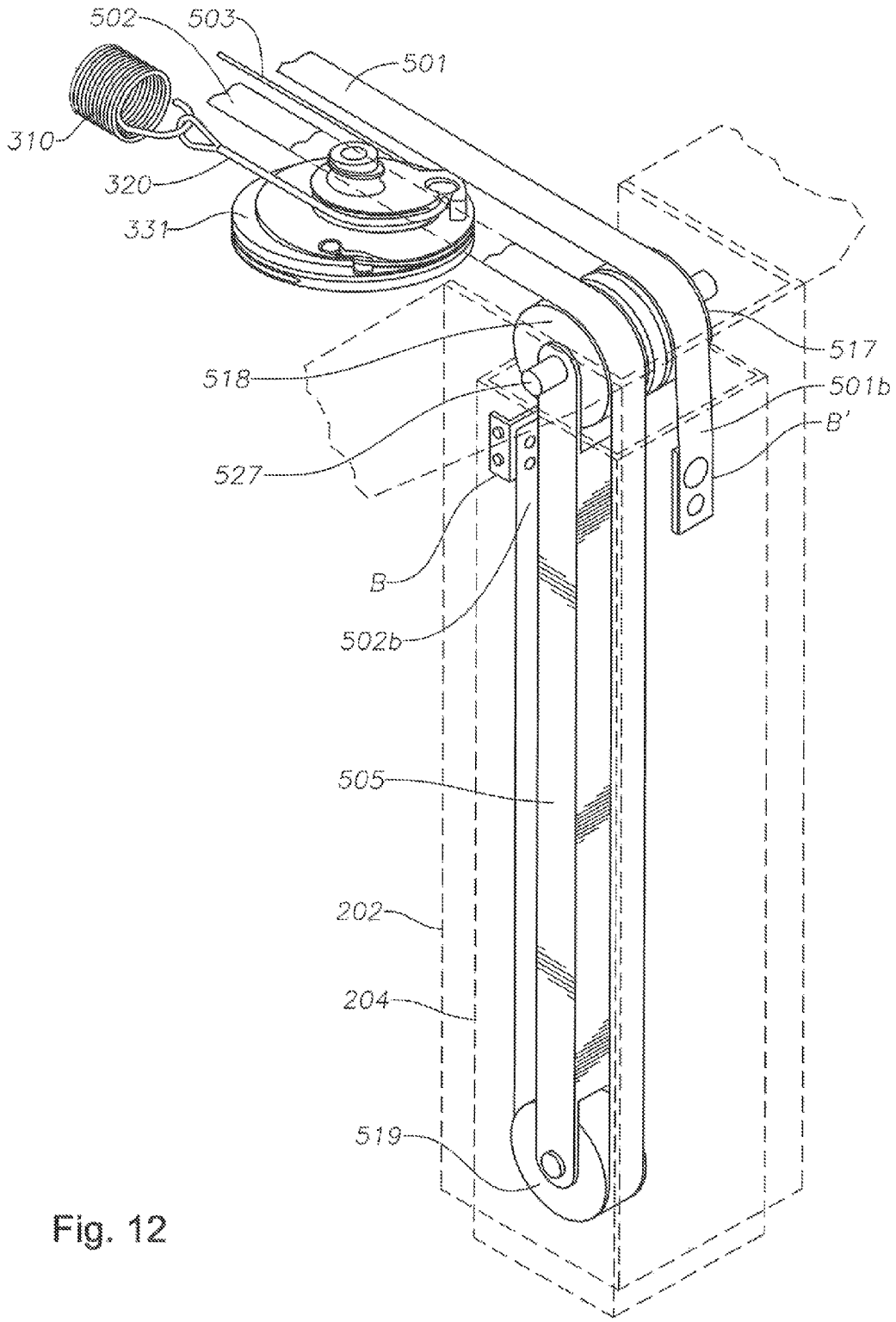
FIG. 12 is a partial perspective view of an embodiment of the height adjustable table's left leg assembly.
Figure 13:
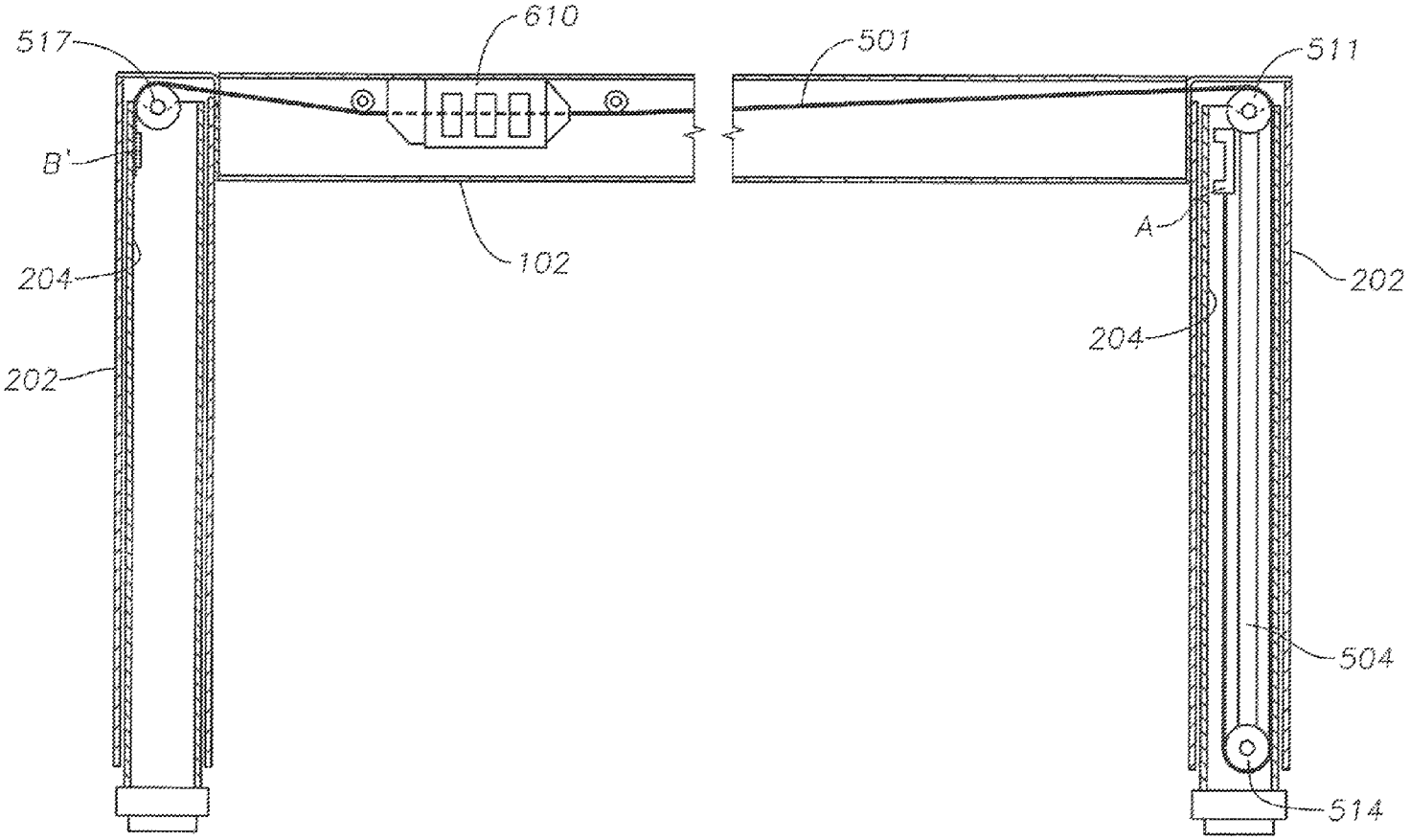
FIG. 13 is a schematic illustration showing the interconnectivity of the synchronized lift mechanism's first band to the right and left leg assemblies of the height adjustable table of the present invention.
Figure 14:
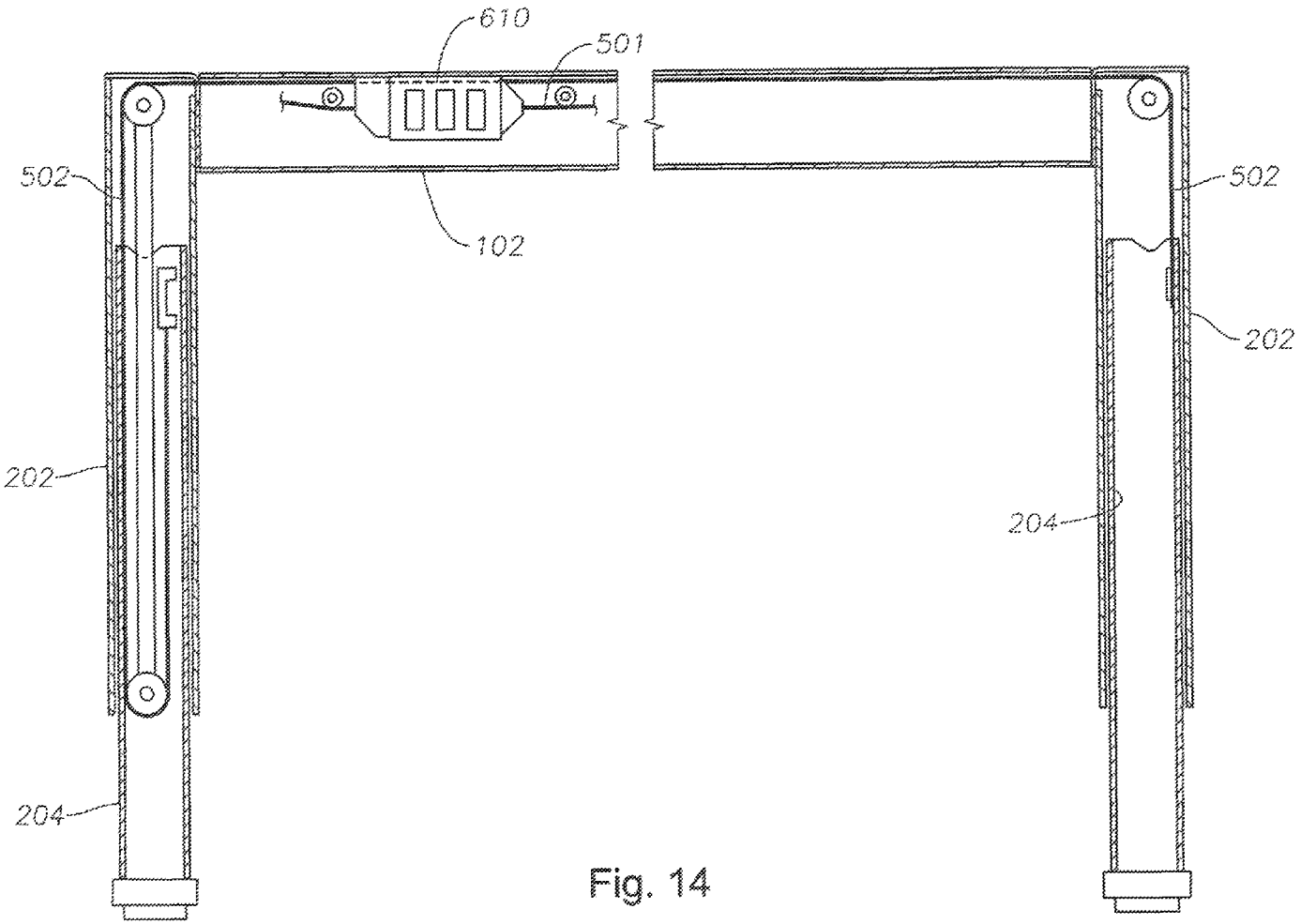
FIG. 14 is a schematic illustration showing the interconnectivity of the synchronized lift mechanism's second band to the right and left leg assemblies of the height adjustable table of the present invention.
Figure 15:
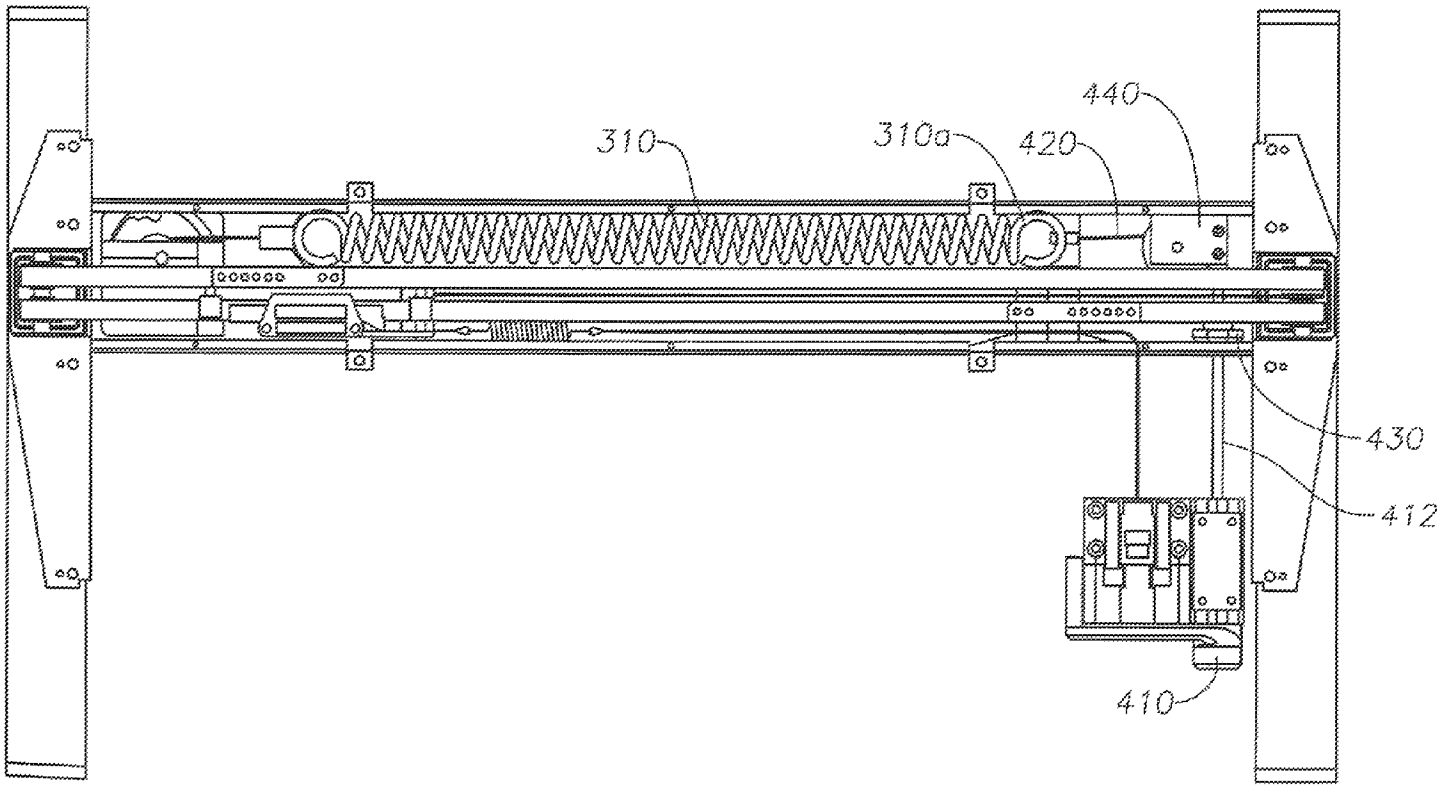
FIG. 15 is a view similar to the view of FIG. 5, except reference numerals related to an embodiment of the preload mechanism are shown.
Figure 16:
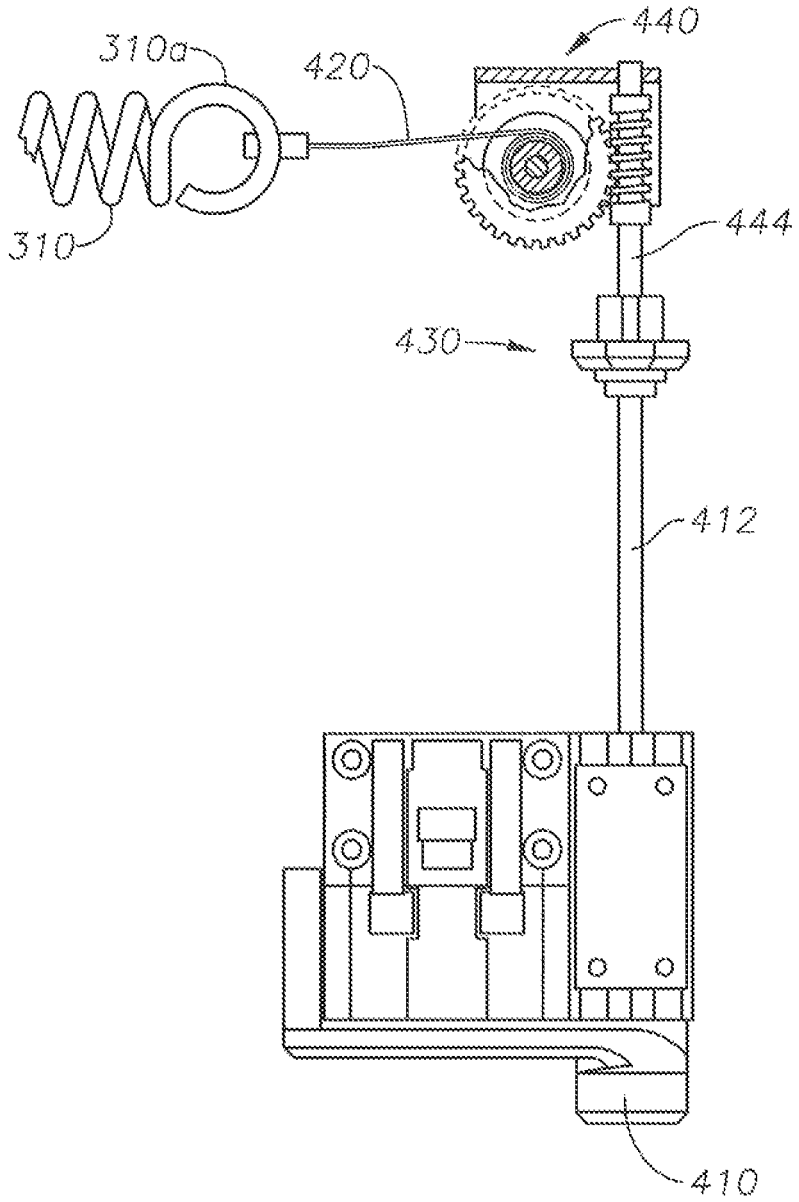
FIG. 16 is a top view of the embodiment of the preload mechanism depicted in FIG. 15.
Figure 17:
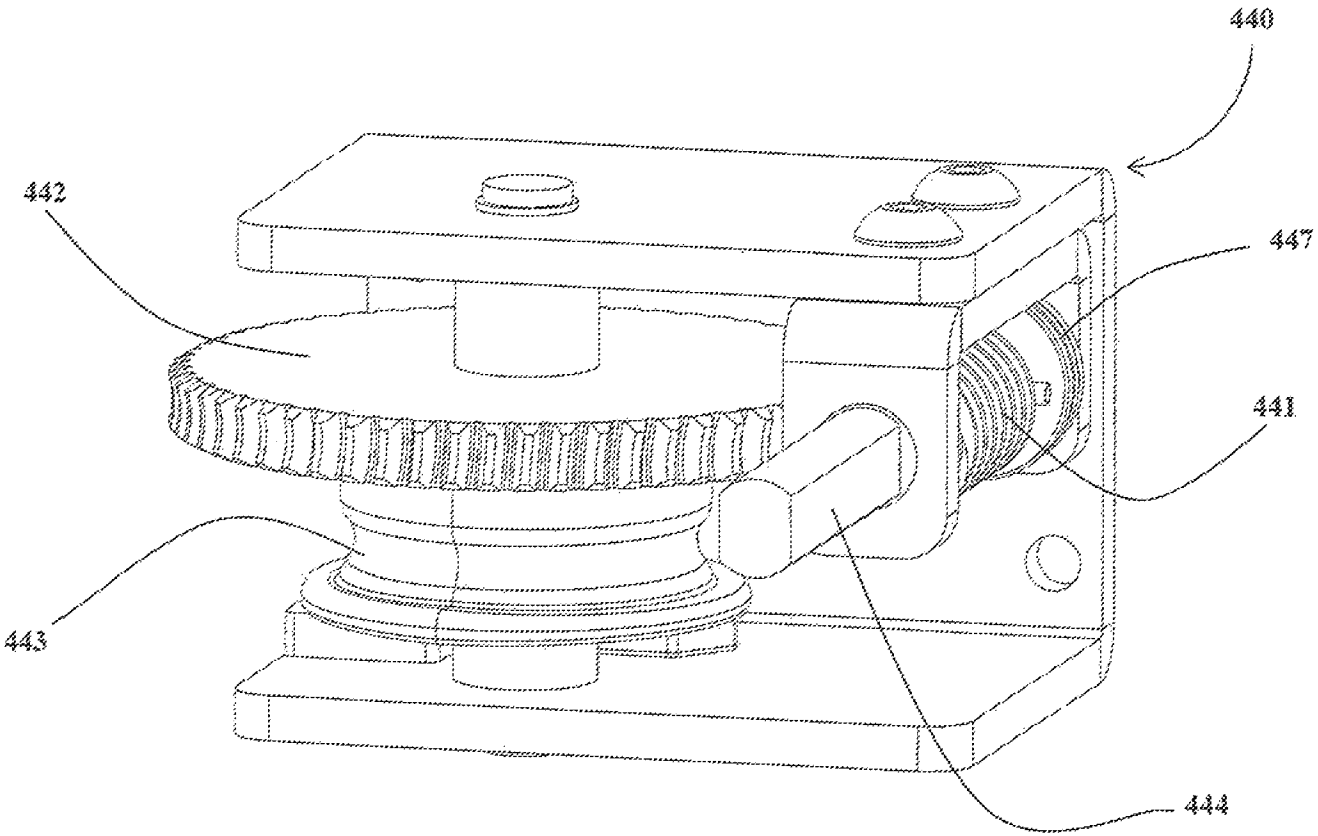
FIG. 17 is a perspective view of an embodiment of the preload mechanism's gearbox.

The first and second bands 501, 502 are operatively engaged with the pulley system as described below. As can be seen, for example, in FIGS. 12-13, the left end 501*b* of the first band 501 is connected to the inside leg 204 of the left leg assembly at attachment point B'. From attachment point B', the first band 501 extends around the first upper pulley 517 of the left pulley assembly, through a lock assembly 610 as it traverses the housing 102, around the first upper pulley 511 of the right pulley assembly, down the right shaft 504, around the lower pulley 514 of the right pulley assembly, and then up the other side of the right shaft 504, where the first band 501 attaches to the right inside leg 204 at attachment point A (See FIGS. 11 and 13). Meanwhile, the right end 502*a* of the second band 502, as can be seen, for example, in FIG. 11, is connected to the inside leg 204 of the right leg assembly at attachment point A'. From attachment point A', the second band 502 extends around the second upper pulley 512 of the right pulley assembly, across the housing 102, around the second upper pulley 518 of the left pulley assembly, down the left shaft 505, around the second lower pulley 519, and up the other side of the left shaft 505, where the second band 502 attaches to the left inside leg 204 at attachment point B (See FIG. 12). In this arrangement, the left and right sides of the lift mechanism are synchronized, which allows the top assembly 100 to be raised and lowered evenly regardless of whether the adjustment force is applied to the middle, right side, or left side of the top assembly 100.

As indicated above, alternative embodiments of the telescoping leg assemblies may feature the inside legs 204 being attached to the top assembly 100 and the outside legs 202 being attached to the foot 210. In such alternative embodiments, one of ordinary skill in the art will readily appreciate that the upper pulleys 511, 512, 513 of the left and right pulley assemblies will be coupled to the inside legs 202 of the telescoping leg assemblies, and the first and second bands 501, 502 of the synchronized lift mechanism will be connected to the outside legs 202 of the telescoping leg assemblies.

Figure 6:
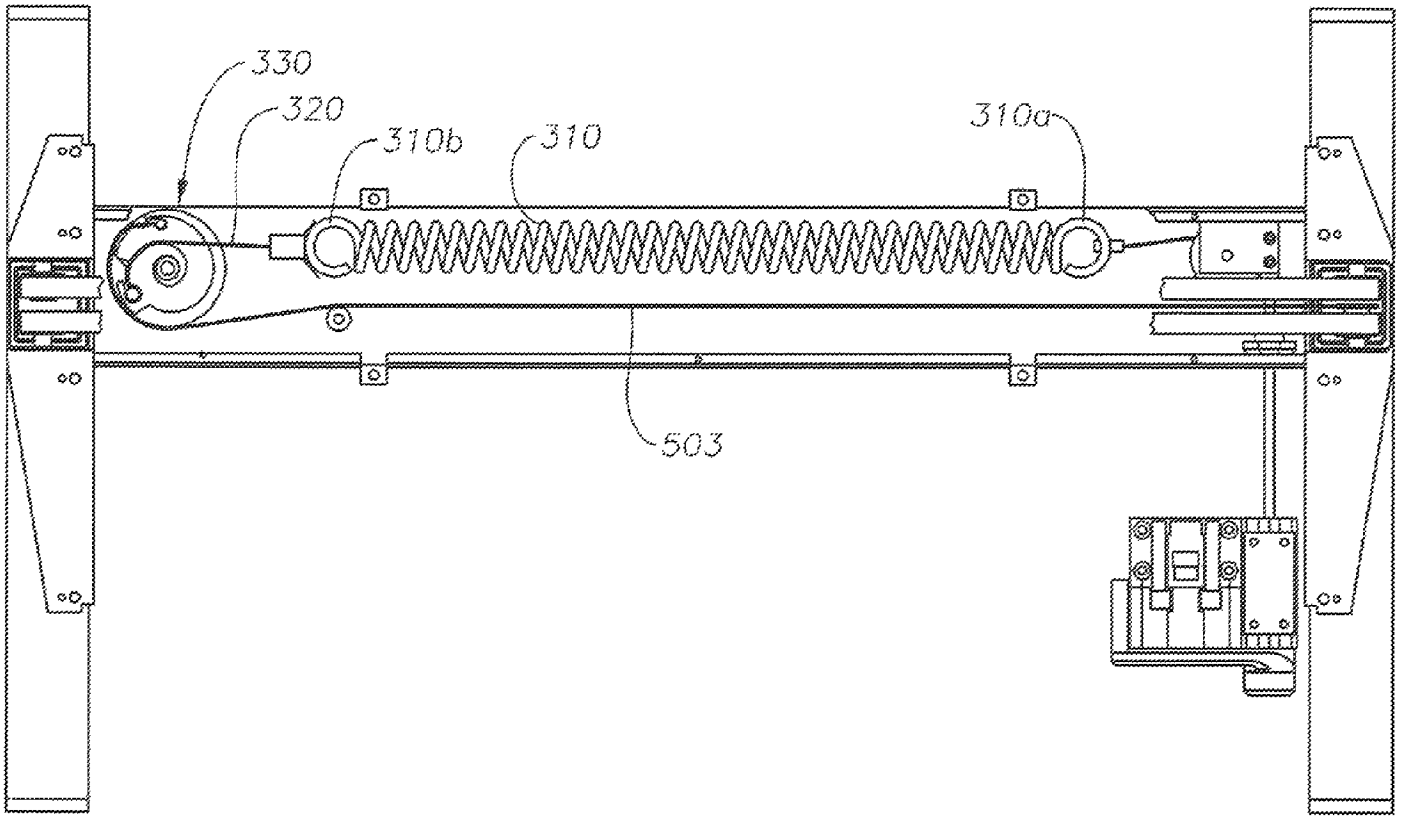
FIG. 6 is a top view of the embodiment of the height adjustable table shown in FIG. 1 wherein the work surface and the top of the housing are removed to reveal the constant-force counterbalance mechanism of the present invention.

The height adjustable table's synchronized lift mechanism is operatively coupled to the counterbalance mechanism by the lift cable 503, as can be seen, for example, in FIGS. 6 and 11. The counterbalance force of the extension spring 310 is transmitted to the synchronized lift mechanism through the lift cable 503. The lift cable 503 is preferably constructed out of ultra-high molecular weight polyethylene such as that manufactured by DSM under the brand Dyneema®. However, one skilled in the art will recognize that the lift cable 503, along with the snail cable 320 and the various other cables disclosed herein, can alternatively be constructed out of a wide variety of materials.

As best illustrated in FIG. 7, a first end of the lift cable 503 is attached to the lift track 331*b* of the snail cam wheel 331 (See FIGS. 8A-8B). The lift cable 503 extends from the snail cam wheel 331, around the upper lift cable pulley 513 of the right pulley assembly, down the right shaft 504, around the lower cable pulley 515, and then up the other side of the right shaft 504, where the lift cable 503 attaches to the inside leg 204 of the right leg assembly (See FIG. 11). The snail cam pulley 330 optionally can include a bearing 339 attached to the mount 335 to prevent the lift cable 503 from inadvertently contacting the mount 335 as the top assembly 100 is raised and lowered.

The degree of height adjustability of the work surface 101 is correlative to the length of the right and left shafts 504, 505. As the top assembly 100 is raised, the right and left pulley assemblies move upwards relative to the inside legs 204. The upward movement of the right pulley assembly shortens the distance between the first lower pulley 514 and attachment point A, the point of attachment for the right end 501*a* of the first band 501. Similarly, the upward movement of the left pulley assembly shortens the distance between the second lower pulley 519 and attachment point B, the point of attachment for the left end 502*b* of the second band 502. As a result, a greater portion of the first and second bands 501, 502 is available to transition about the pulley system to allow for the vertical extension of the top assembly 100.

Additionally, in an exemplary embodiment, each shaft 504, 505 includes a stop member at its lower end (i.e., near the lower pulleys 515, 519) operable to engage with stop members disposed within the corresponding inside legs 204, near the top of each inside leg 204 (i.e., near attachment points A and B). The stop members on the shafts 504, 505 cooperate with the stop members on the inside legs 204 to prohibit further movement of the top assembly 100 relative to the base assembly 200.

Figure 9:
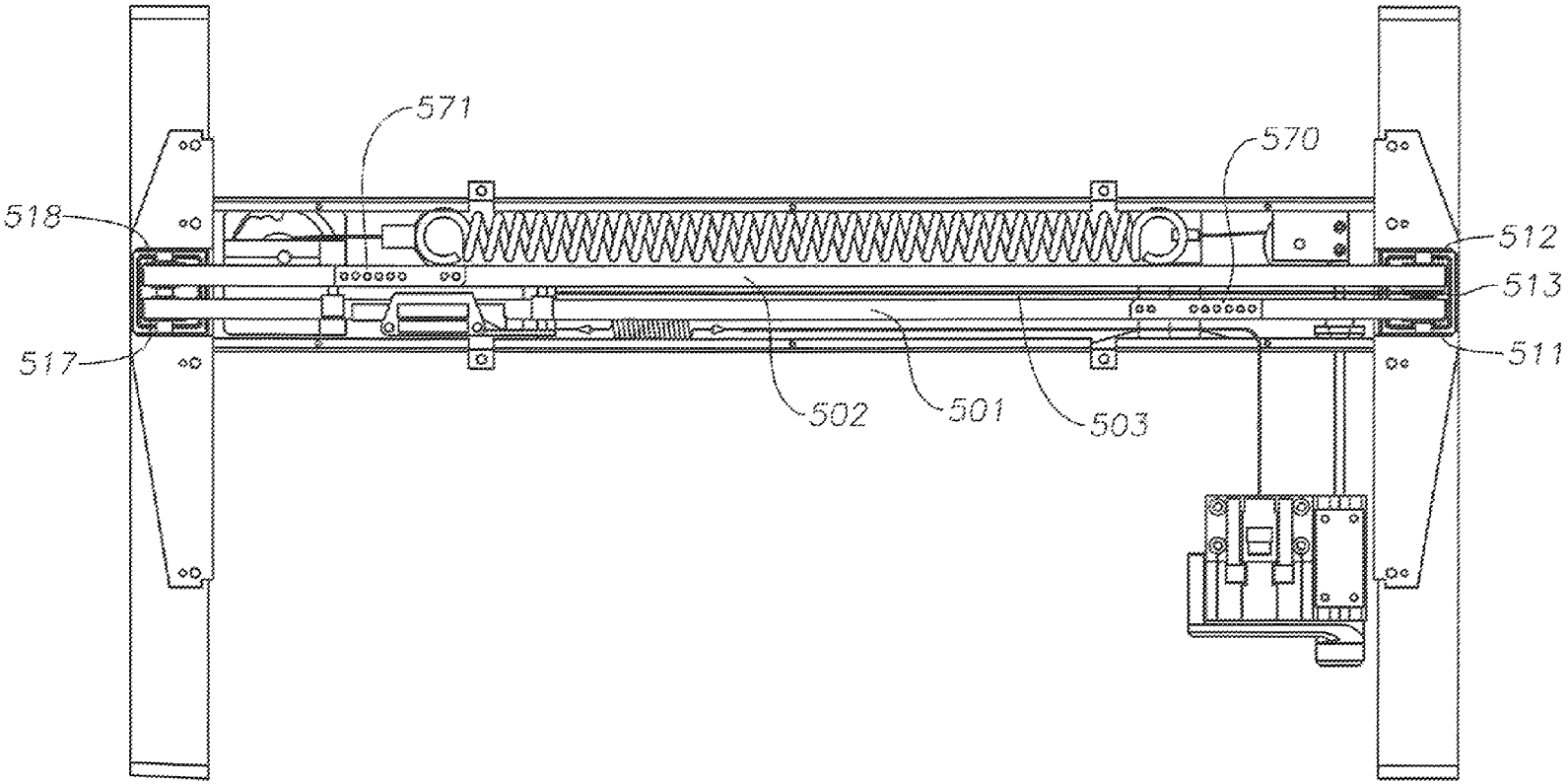
FIG. 9 is a view similar to the view of FIG. 5, except reference numerals related to an embodiment of the synchronized lift mechanism are shown.
Figure 10:
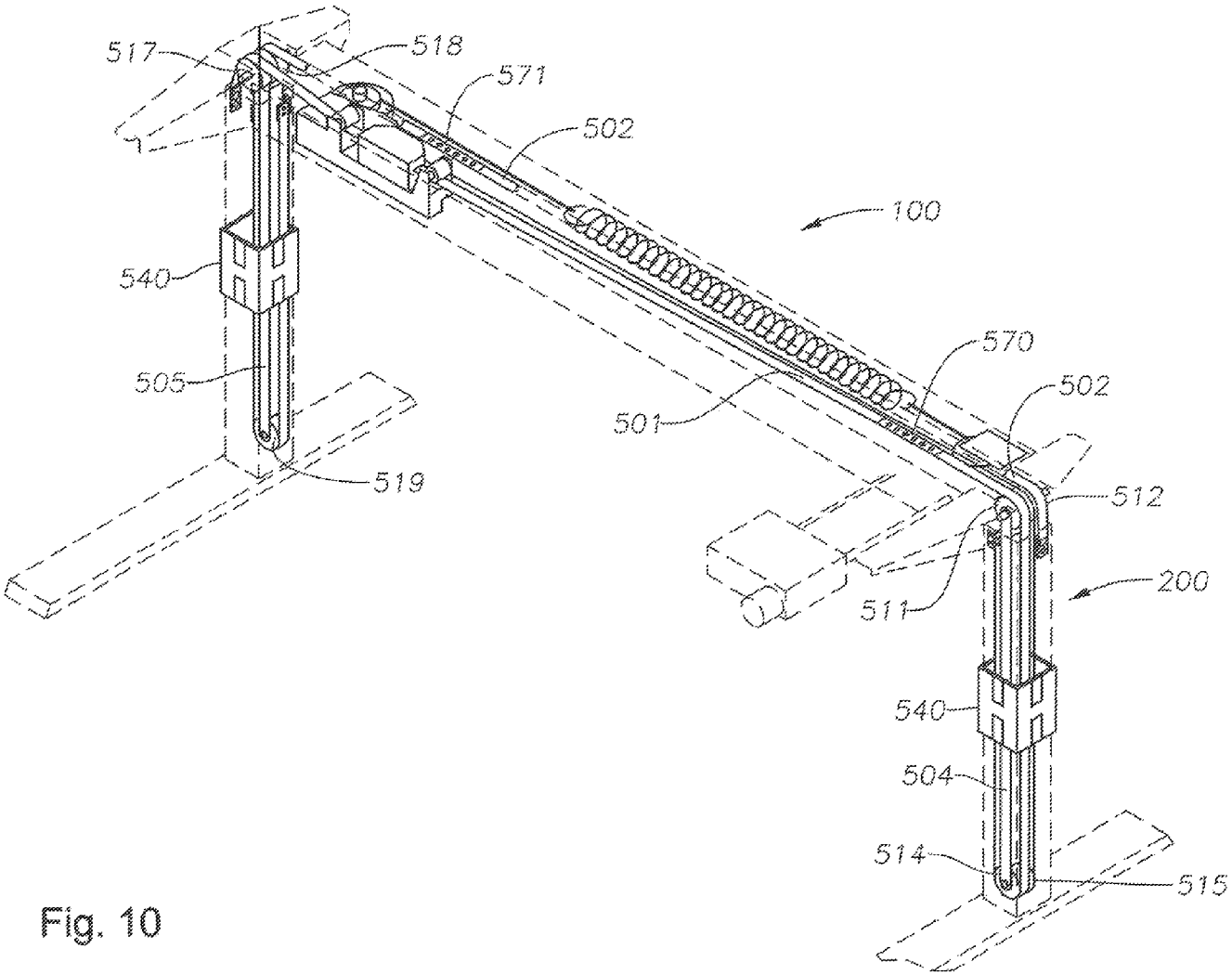
FIG. 10 is a right-side perspective view of the embodiment of the height adjustable table shown in FIG. 1.

In the embodiment depicted in FIGS. 9 and 10, the first and second bands 501, 502 can each comprise right and left sections joined by connectors 570, 571, respectively. The connectors 570, 571 allow for length adjustment of the first and second bands 501, 502 in order to tune the synchronized lift mechanism over the lifespan of the table 1. In other embodiments, the first and second bands 501, 502 can be continuous pieces of material. The first and second bands 501, 502 preferably are constructed out of metallic or semi-metallic material having a relatively high tensile strength, such as steel. However, one skilled in the art will recognize that the bands 501, 502 can alternatively be constructed out of a wide variety of materials and take on a wide variety of shapes. As used herein, the terms "band" or "bands" are defined broadly to include bands, cords, cables, ropes or any other slender length of flexible material.

Referring now to FIGS. 15-20, the height adjustable table 1 of the present invention optionally may include a preload mechanism for balancing the counter-weighting force with the applied load on the top assembly 100. A disparity between the counter-weighting force and the load can make counterbalance tables hard to control when altering the height of the work surface. Such rapid, uncontrolled movement of the work surface 101 can present a safety risk. This risk is exacerbated by the fact that tables are often exposed to varying loads due to the addition and/or removal of objects on the work surface 101. The preload mechanism of the present invention allows the counter-weighting force to be easily adjusted by the user to relatively match the load (i.e., it is load-variable), thereby eliminating this safety risk while providing a work surface 101 that can be moved up and down with minimal effort.

The preload mechanism embodying the principles of the present invention can comprise a gearbox 440 connected to the first end 310*a* of the tension spring 310 by a preload cable 420. The gearbox 440 can include a worm 441 meshed with a worm wheel 442 to form a worm drive. One end of the preload cable 420 can be attached to the hub 443 and the hub 443 in turn can be coupled to the worm wheel 442. Moreover, a wormshaft 444 can be attached to, or integrally formed with, the worm 441, and a handle 410 can be attached to the wormshaft 444 in order to rotate the wormshaft 444. Optionally, a thrust bearing 447 can be positioned between the worm 441 and a housing 445 of the gearbox 440 to reduce friction.

In operation, a user can increase the initial tension or preload of the tension spring 310 by turning the handle 410 in a first direction, e.g., clockwise. The rotation of the handle 410 in the first direction will cause the wormshaft 444 and worm 441 to also rotate in a first direction. The rotation of the worm 441 will drive the worm wheel 442 to rotate about its axis, which in turn will cause the hub 443 to rotate. The rotation of the hub 443 will cause the preload cable 420 to wind around the hub 443 and gradually extend the tension spring 310 until the total force exerted by the tension spring 310 is substantially equal to the load to be counter-weighted. One skilled in the art will recognize that the initial tension imparted by the preload mechanism can subsequently be reduced simply by turning the handle 410 in a second direction, e.g., counterclockwise.

Figure 20:
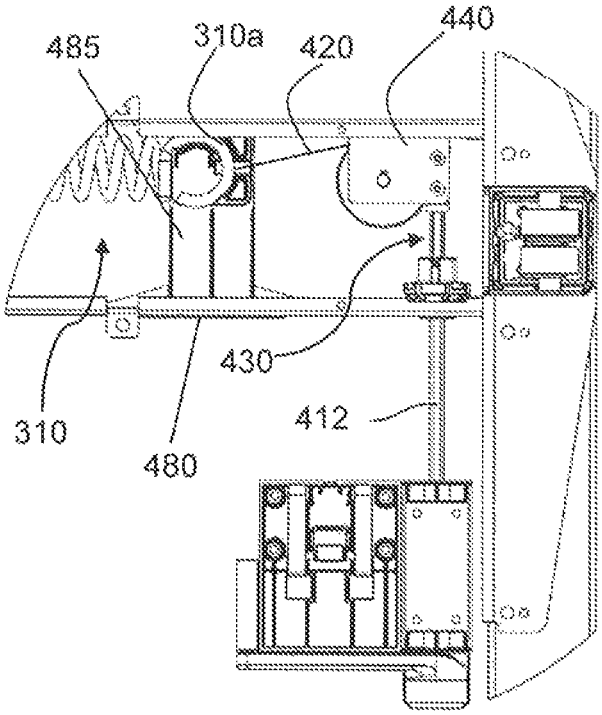
FIG. 20 is a top view of the embodiment of the preload mechanism depicted in FIG. 15.

As shown in FIG. 20, the preload mechanism optionally can include a load indicator coupled to the first end 310*a* of the tension spring 310. The load indicator may comprise a load indicator arm 485 attached to the first end 310*a* of the extension spring 310. As the user turns the handle 410 to adjust the preload, both the tension spring 310 and the load indicator arm 485 move laterally. The positioning of the load indicator arm 485, which is indicative of the magnitude of the preload, can be viewable from the front of the table 1 through the load indicator faceplate 480.

Figure 18A:
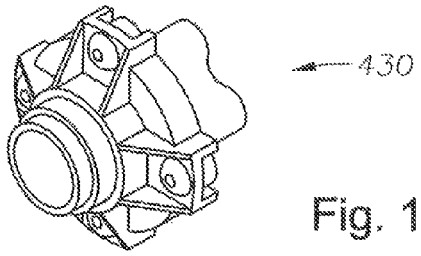
FIGS. 18*a*, 18*b*, and 18*c* are perspective views of an embodiment of the preload mechanism's torque limiter.
Figure 18B:
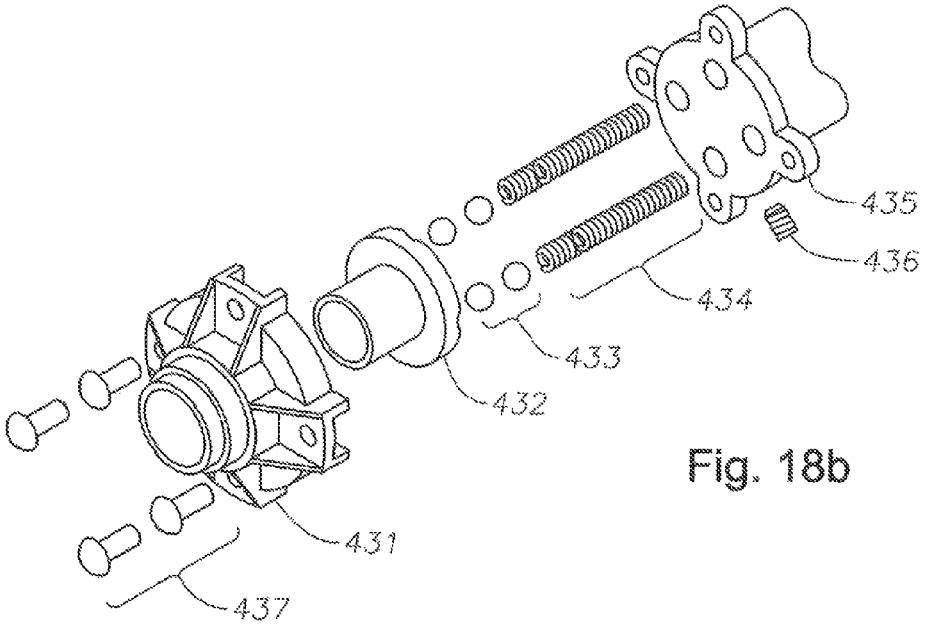
Figure 18C:
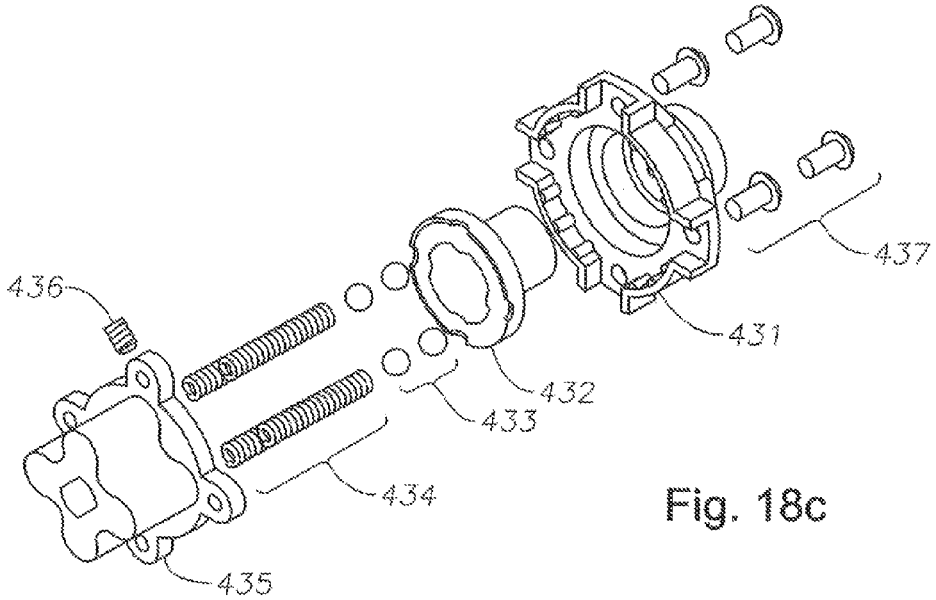
Figure 19:
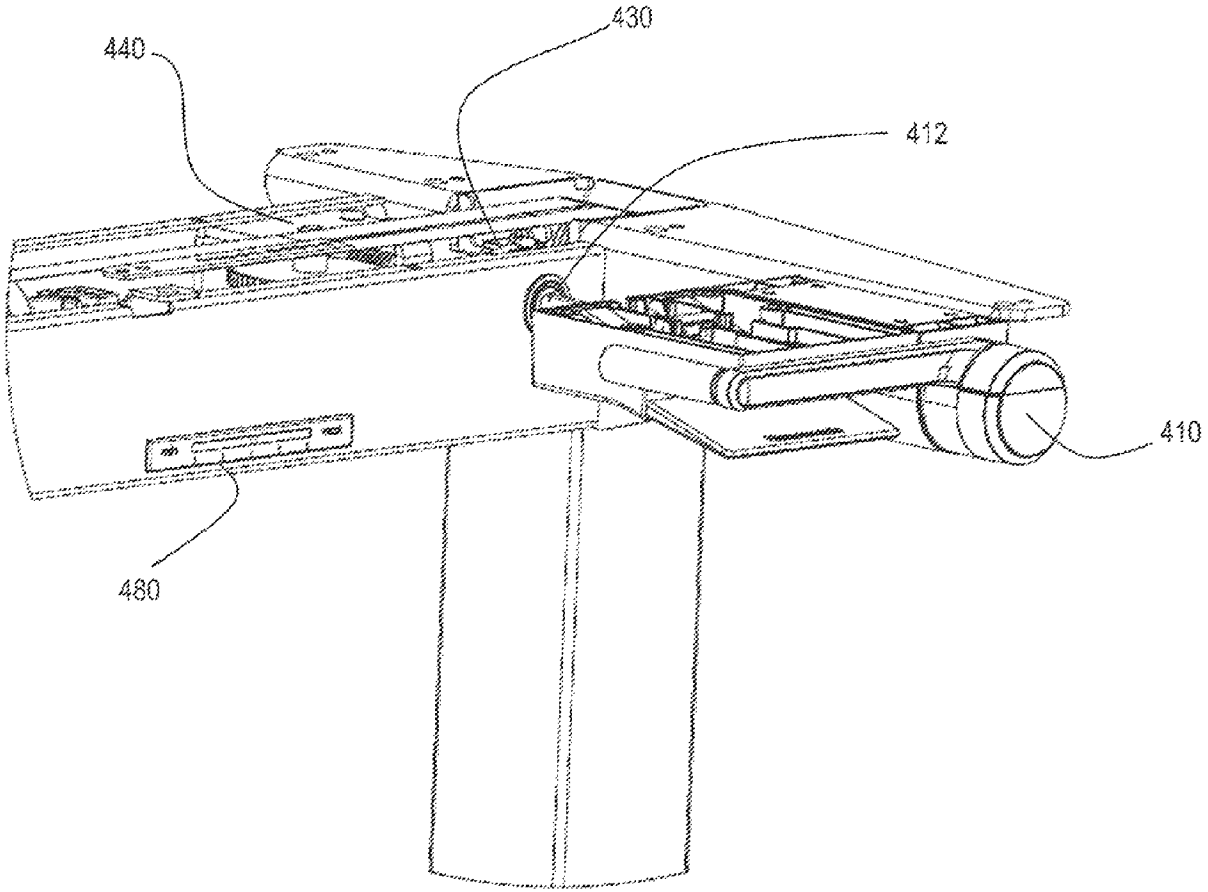
FIG. 19 is a perspective view of the embodiment of the preload mechanism depicted in FIG. 15.

In certain embodiments, a torque limiter 430 can be utilized to protect the gearbox 440 from being damaged due to excessive torque being applied to the worm 441. A ball detent type torque limiter 430 is depicted in FIGS. 18*a*-18*c*. In alternative embodiments, other types of torque limiters (e.g., shear pin, synchronous magnetic, pawl and spring, etc.) may be utilized.

Referring to FIGS. 18*a*-18*c*, the torque limiter 430 includes a drive coupling 431, a drive plate 432, a plurality of drive balls 433, a plurality of springs 434, a driven coupling 435, a set screw 436, and a plurality of fasteners 437. The drive coupling 431 is attached to the handle 410 via a driveshaft 412, while the driven coupling 435 is attached to the wormshaft 444 and secured with the set screw 436. Torque applied to the drive coupling 431 is transmitted to the driven coupling 435 through the drive balls 433, which rest in detents on the drive plate 432 and are held in place with the springs 434. In an overload condition, when the worm 441 has reached its linear travel limit within the gearbox 440, the drive balls 433 will separate from the drive plate 432 to disengage the drive coupling 431 from the driven coupling 435.

Referring now to FIGS. 21-24, the height adjustable table 1 of the present invention optionally may also include a lock mechanism, which locks the top assembly 100 at various heights and also prevents height adjustment of the top assembly 100 if the table 1 is not properly counterbalanced. The lock mechanism may comprise a release assembly (described below) coupled to a lock assembly 610. The lock assembly 610 can engage either the first band 501 or the second band 502 (See FIGS. 7 and 9-12) to prevent movement of the first band 501 or the second band 502, which in turn prevents height adjustment of the top assembly 100. The lock assembly 610 is biased to a locked or engaged position, but can be disengaged to an unlocked position by actuating the release assembly.

Figure 22:
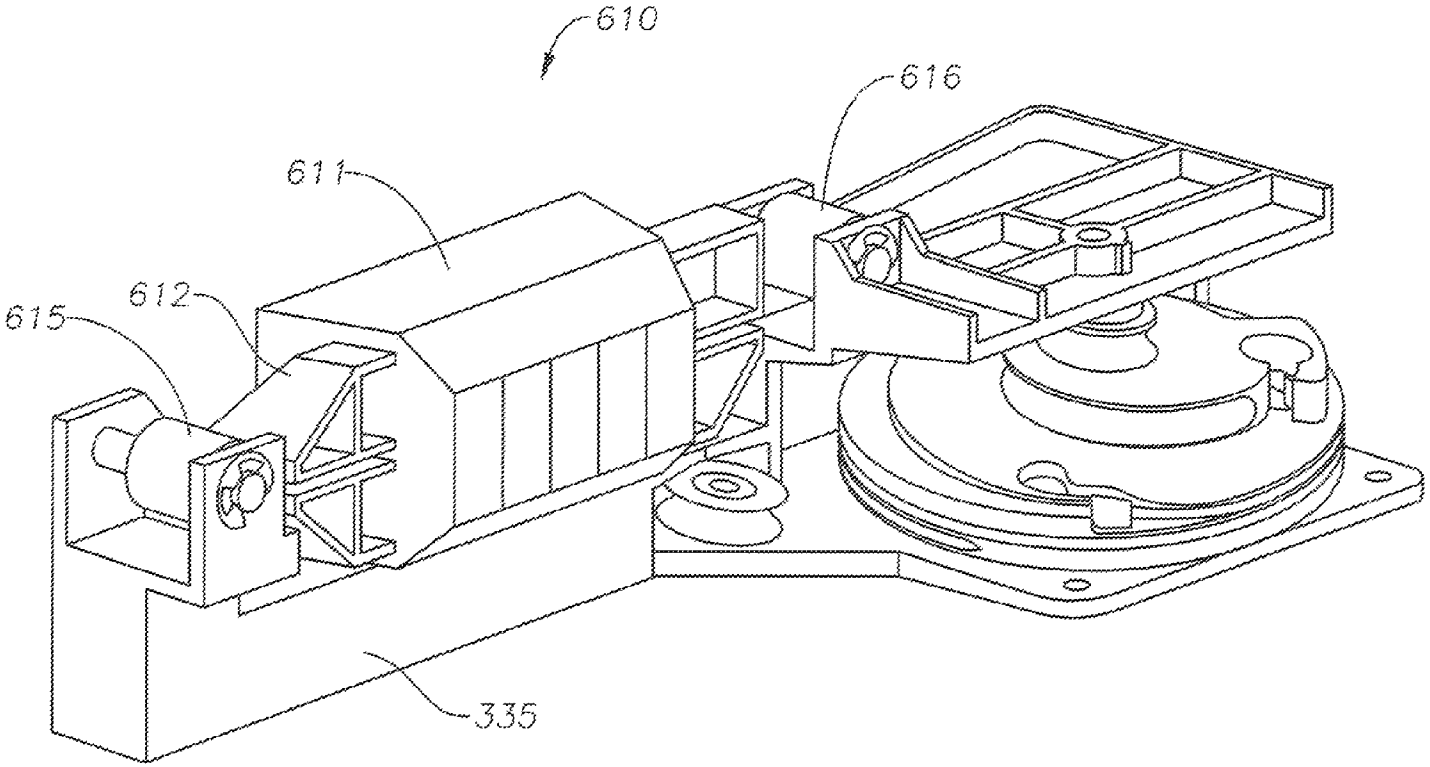
FIG. 22 is a perspective view of an embodiment of the lock mechanism's lock assembly.

A preferred embodiment of a lock assembly 610 is depicted in FIG. 22. As illustrated, the lock assembly 610 can comprise a lock housing 611 that contains an upper lock member and a lower lock member. The upper and lower lock members may include any suitable locking means known in the art, including but not limited to, a system of upper rollers and a system of lower rollers or opposing locking plates. In this embodiment, the first band 501 is routed through the lock housing 611 such that the upper and lower lock members are positioned on opposing sides of the first band 501. The upper and lower lock members are biased towards one another to engage the first band 501 to prevent its movement, thereby defining the locked position. Upon actuation of the release assembly, a lock release member 612 is actuated to cause the upper and lower lock members to move from the biased, locked position to release the first band 501. First and second guiding rollers 615, 616 can be utilized to direct the first band 501 through the lock housing 611. The lock release member 612 is designed to have a variable pull weight, which increases as the difference between the load and the counterbalance force increases. Thus, when the table 1 is not properly balanced, the pull weight of the lock release member 612 will be increased.

Figure 21:
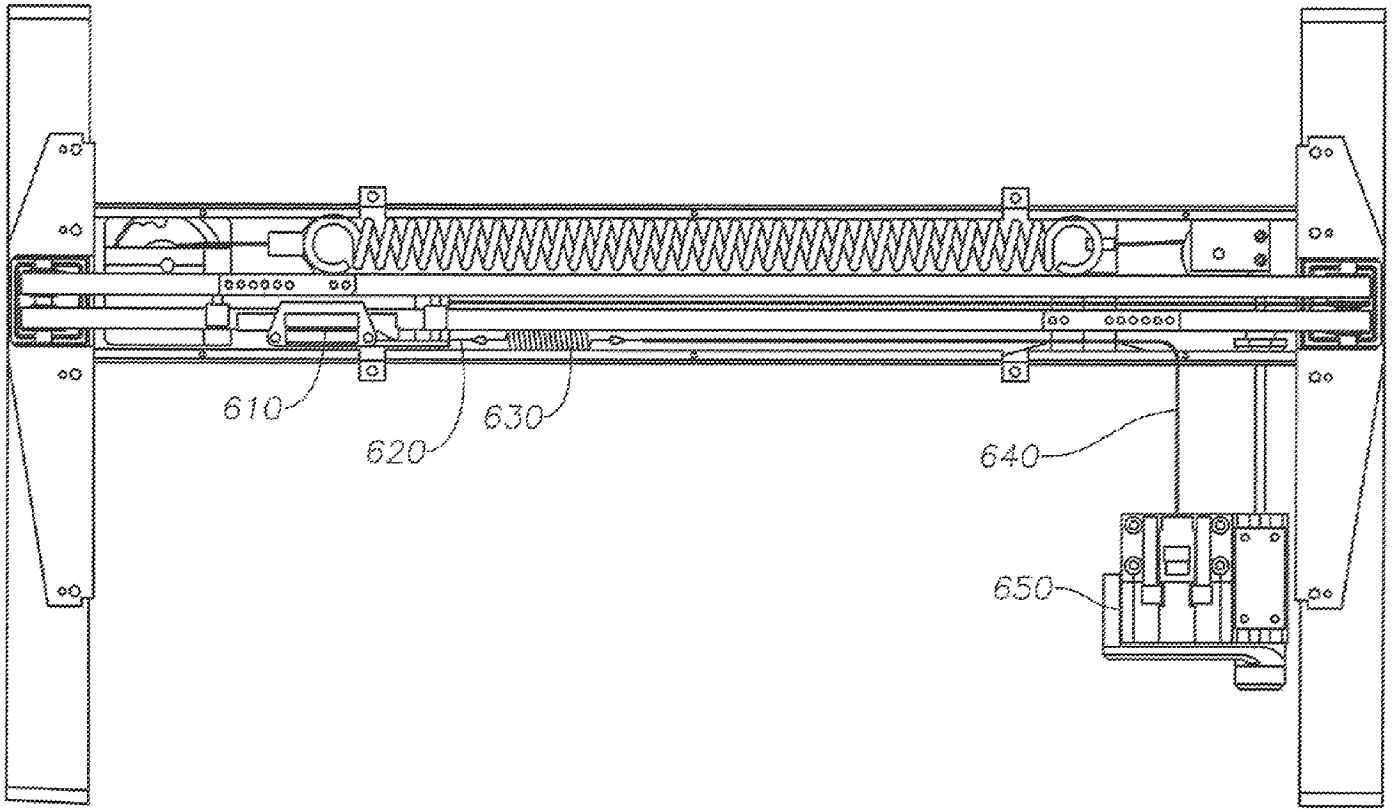
FIG. 21 is a view similar to the view of FIG. 5, except reference numerals related to an embodiment of the lock mechanism are shown.
Figure 24:
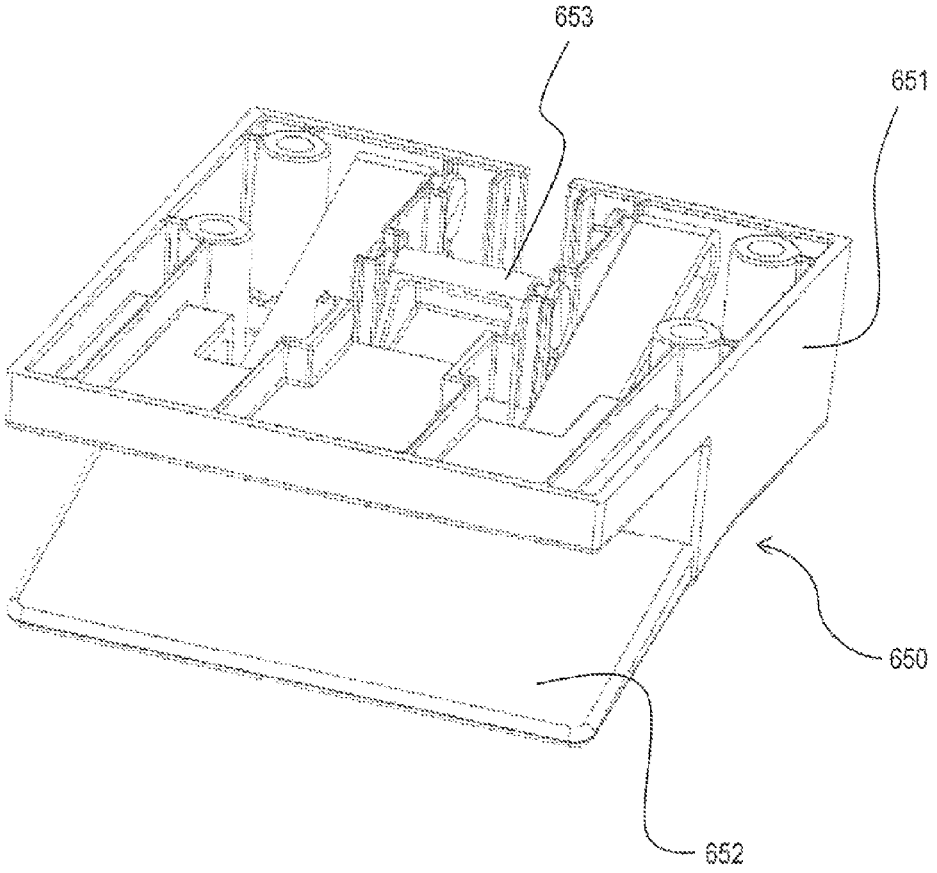
FIG. 24 is a perspective view of an embodiment of the lock mechanism's release assembly.

Referring to FIG. 21, the release assembly can comprise an actuation member 650, a safety spring 630, a first cable 640 connecting the actuation member 650 to the first end of the safety spring 630, and a second cable 620 connecting the second end of the safety spring 630 to the lock release member 612. As depicted in FIG. 24, the actuation member 650 preferably comprises a release case 651 housing a release paddle 652 coupled to a release cam 653.

In operation, the lock release member 612 can be actuated by pressing the release paddle 652, thereby causing the release cam 653 to rotate and pull the first cable 640. This movement causes a tension force that is then transmitted through the safety spring 630 and the second cable 620 before acting on the lock release member 612. In a preferred embodiment, the safety spring 630 will deflect and cease to transmit the tension force generated by the actuation member 650 when placed under a load of 30 lbs. of force or higher. In this manner, the variable pull weight of the lock release member 612 functions together with the safety spring 630 to provide a release override feature, preventing height adjustment of the top assembly 100 if the disparity between the load and the counterbalance force reaches a certain level. For instance, if the disparity between the load and the counterbalance force reaches approximately 65 lbs., the trigger pull weight will exceed the capabilities of a tension spring rated at 30 lbs. and the lock release member 612 will not be actuated.

Figure 23:
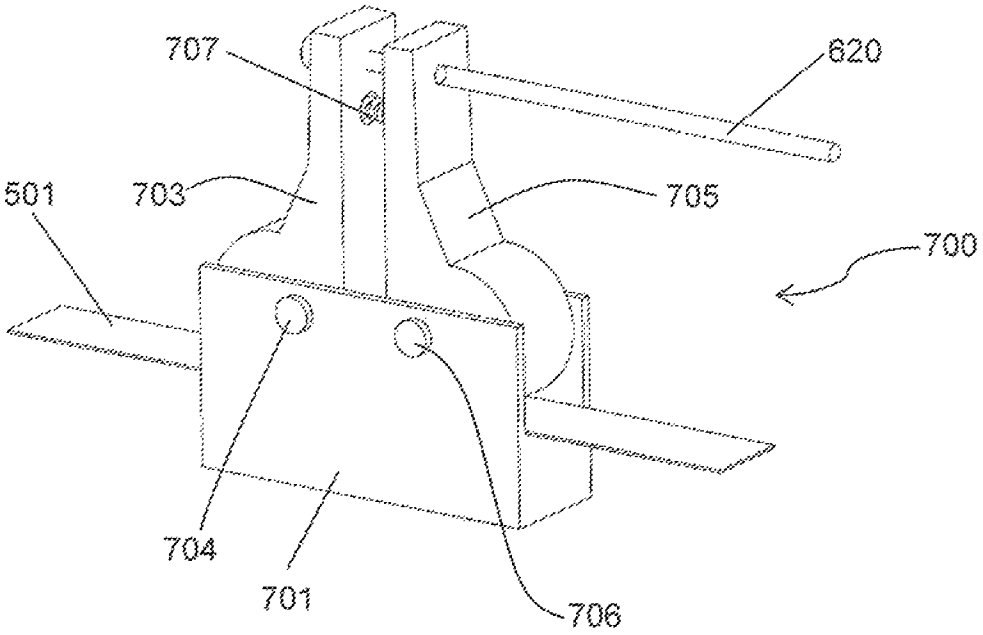
FIG. 23 is a perspective view of another embodiment of the lock mechanism's lock assembly.

Referring now to FIG. 23, an alternative embodiment of a lock assembly 700 is shown. The lock assembly 700 comprises first and second cam members 703, 705 that are pivotally connected to a base block 701 with pins 704, 706, respectively. The lock assembly 700 is biased to a locked or engaged position by a spring 707. In operation, the lock assembly 700 can be actuated, or disengaged from the locked position, by pressing the release paddle 652, thereby causing the release cam 653 to rotate and pull the first cable 640. This tension force is then transmitted through the safety spring 630 and the second cable 620 before ultimately causing the cam members 703, 705 to pivot about the pins 704, 706 and release the first band 501.

In a further embodiment, height adjustable table 1 of the present invention may include an automatically adjustable height adjustment mechanism that automatically adjusts the height of the top assembly 100 and the attached work surface 101 to a predetermined ergonomic position associated with an input height. As used in the specification and claims, "automatically adjustable" is defined as being moveable by a non-manual force to a predetermined position, the predetermined position being based on information obtained by or contained within a device such as a controller, processor, computer, or database.

In an exemplary embodiment, the automatically adjustable height adjustment mechanism can electronically adjust the height of the top assembly 100 to assume an ergonomically proper position for the user, reducing the need for independent adjustment of the top assembly 100. The top assembly 100 can include a control panel (not shown) that is in communication with a processor (not shown) and the processor in turn is in communication with a database that contains a list of possible user heights and the predetermined ergonomic positions associated with each of the possible heights. The processor and the database can be located within the base assembly 200 or the top assembly 100 of the table 1. Alternatively, the processor and/or the database can be located remote from the table 1, but in wireless communication with each other and/or the control panel. The processor can be in communication with a motorized lift mechanism located within either the base assembly 200 or the top assembly 100 of the table 1.

The control panel can include a touch screen with a series of number scrolls, a slide bar, a number pad, buttons, knobs or other suitable means accessible to the user for the input of the user's height. Alternatively, the control panel can include a number of pre-set height options selectable via a touch screen, buttons, or knobs. The pre-set height options may include specific heights (e.g., 5'1", 5'2", 5'3", etc.) or height ranges (e.g., a button for heights in the range of 4'8" to 5'0", a button for heights in the range of 5'1" to 5'3", a button for heights in the range of 5'4" to 5'6" and so forth). In another alternative embodiment, each user has an access ID, with his/her height information associated therewith, identifiable by the control panel through, for example, swiping an access ID card or inputting an access ID code. Near field communication technology, such as embedded within a user's cellular phone, can also allow the table to recognize the identity of a user and obtain the height information associated with that user.

In yet another alternative embodiment, the height of the work assembly 101 can be communicated to the user as the height of the top assembly 100 changes, through, for example, a display screen showing numbers scrolling, an icon indicating height increase, a slide bar, or a display of changing numbers indicating the height change. In an even further alternative embodiment, the table 1 can be equipped with a sensor (e.g., retinal, sonar, laser, IR, motion, position, and heat detecting sensor, a camera, or other measuring devices) operable to detect a measurable aspect of a user, such as the height of a user, and communicate the detected information to the processor. The sensor(s) can be coupled to the top assembly 100.

As an example, the height adjustable table 1 comprising an automatically adjustable height adjustment mechanism may be operated as follows. When a user approaches the height adjustable table 1, the user may input his/her height at the control panel. The height information is communicated to and received by the processor, which communicates with the database to obtain the predetermined ergonomic position information associated with the user's input height. Based upon the received predetermined ergonomic position information, the processor communicates an instruction to the motorized lift mechanism to adjust the top assembly 100 to the predetermined ergonomic position. Accordingly, the work surface 101 automatically adjusts to a height that is ergonomic for the user, thereby eliminating the need to manually adjust the height of the work surface.

The foregoing description and accompanying drawings illustrate the principles, exemplary embodiments, and modes of operation of the invention. However, the invention should not be construed as being limited to the particular embodiments discussed above. Many modifications of the embodiments described herein will come to mind to one skilled in the art having the benefit of the teaching presented in the foregoing descriptions and the associated drawings. Accordingly, it should be appreciated that variations to those embodiments can be made by those skilled in the art without departing from the scope of the invention.

What is claimed is:

1. A height adjustable table comprising:

a top assembly comprising a housing and a work surface supported on the housing;

a constant-force counterbalance mechanism disposed within the housing;

a base assembly, which supports the top assembly, the base assembly comprising a first telescoping leg assembly and a second telescoping leg assembly, the first telescoping leg assembly and the second telescoping leg assembly each comprising an outside leg and an inside leg having a variable overlap to accommodate height adjustment of the top assembly; and a preload mechanism positioned within the housing and operatively coupled to the constant-force counterbalance mechanism, the preload mechanism comprising:

a gearbox having a worm wheel;

a worm meshed with the worm wheel to form a worm drive;

a hub coupled to the worm wheel;

a preload cable having a first end attached to the hub and a second end attached to the constant-force counterbalance mechanism; and a handle coupled to the worm drive.

2. The height adjustable table of claim 1, wherein the constant-force counterbalance mechanism comprises:

a tension spring for providing a counter-weight force, the tension spring having a first end and a second end;

a snail cam pulley comprising a snail cam wheel secured to a mount by an axle, the snail cam wheel having a cam track and a lift track; and a snail cable coupling the second end of the tension spring to the cam track of the snail cam wheel.

3. The height adjustable table of claim 2, further comprising a synchronized lift mechanism operatively coupled to the constant-force counterbalance mechanism to provide synchronized lifting or lowering of the top assembly, the synchronized lift mechanism comprising:

a first pulley assembly and a second pulley assembly, the first pulley assembly associated with the first telescoping leg assembly and the second pulley assembly associated with the second telescoping leg assembly;

a first band and a second band each operatively coupled to the first and second pulley assemblies; and a lift cable having a first end attached to the lift track of the snail cam wheel and a second end attached to the inside leg of one of the first and second telescoping leg assemblies.

4. The height adjustable table of claim 2, further comprising a load indicator coupled to the first end of the tension spring.

5. The height adjustable table of claim 3, wherein each of the first and second pulley assemblies comprises:

at least one upper pulley;

at least one lower pulley; and a shaft coupling the at least one lower pulley to the at least one upper pulley, wherein the shaft is suspended within an internal cavity of the respective telescoping leg assembly.

6. The height adjustable table of claim 5, wherein a first end of the second band is connected to the inside leg of the first telescoping leg assembly and extends around the at least one upper pulley of the first pulley assembly, across the housing, around the at least one upper pulley of the second pulley assembly, around the at least one lower pulley of the second pulley assembly, and connects at a second end to the inside leg of the second telescoping leg assembly.

7. The height adjustable table of claim 3, further comprising a lock mechanism positioned within the housing for fixing the top assembly at a desired height, the lock mechanism comprising:

a lock assembly having a release position and a lock position, the lock assembly having upper and lower lock members positioned on opposing sides of at least one of the first and second bands and configured to prevent height adjustment of the top assembly when the lock assembly is positioned in the lock position; and a release assembly having an actuation member, a safety spring, a first cable connecting the actuation member to the safety spring, and a second cable connecting the safety spring to the lock assembly.

8. The height adjustable table of claim 5, wherein the lift cable extends from the lift track around the at least one upper pulley of the first pulley assembly and around the at least one lower pulley of the first pulley assembly, and attaches to the inside leg of the first telescoping assembly.

9. The height adjustable table of claim 5, wherein the lift cable extends from the lift track around the at least one upper pulley of the second pulley assembly, around the at least one lower pulley of the second pulley assembly, and attaches to the inside leg of the second telescoping assembly.

10. The height adjustable table of claim 6, wherein a first end of the first band is connected to the inside leg of the second telescoping leg assembly and extends around the at least one upper pulley of the second pulley assembly, across the housing, around the at least one upper pulley of the first pulley assembly, around the at least one lower pulley of the first pulley assembly, and connects at a second end to the inside leg of the first telescoping leg assembly.

11. The height adjustable table of claim 1, wherein the preload mechanism further comprises a torque limiter positioned between the handle and the worm to decouple the handle from the worm drive when a torque exerted by the handle on the worm drive exceeds a predetermined amount.

12. A height adjustable table comprising:

a base assembly comprising a first telescoping leg assembly and a second telescoping leg assembly, each of the first telescoping leg assembly and the second telescoping leg assembly comprising:

an outside leg; and an inside leg, one of the outside and inside legs being fixedly coupled to a stationary foot, the outside and inside legs having a variable overlap;

a top assembly supported by the base assembly, the top assembly comprising a work surface mounted to a housing;

a constant-force counterbalance mechanism positioned within the housing; and a synchronized lift mechanism operatively coupled to the constant-force counterbalance mechanism to provide synchronized lifting and lowering of the top assembly relative to the stationary feet of the base assembly, the synchronized lift mechanism comprising:

a first pulley assembly positioned within the first telescoping leg assembly;

a second pulley assembly positioned within the second telescoping leg assembly;

a first band operatively coupled to the first and second pulley assemblies;

a second band operatively coupled to the first and second pulley assemblies; and a lift cable having a first end attached to the constant-force counterbalance mechanism and a second end attached to the inside leg of one of the first and second telescoping leg assemblies.

13. The height adjustable table of claim 12, wherein the constant-force counterbalance mechanism comprises:

a snail cam pulley including a snail cam wheel secured to a mount by an axle, the snail cam wheel having a cam track and a lift track;

a tension spring having a first end and a second end; and a snail cable coupling the second end of the tension spring to the cam track of the snail cam wheel.

14. The height adjustable table of claim 12, further comprising: a preload mechanism positioned within the housing and operatively coupled to the constant-force counterbalance mechanism for modulating a counter-weight force provided by the constant-force counterbalance mechanism.

15. The height adjustable table of claim 14, further comprising a lock mechanism positioned within the housing for fixing the top assembly at a desired height, the lock mechanism comprising a lock assembly having a release member and upper and lower lock members positioned on opposing sides of at least one of the first and second bands to prevent height adjustment of the top assembly.

16. The height adjustable table of claim 14, wherein the preload mechanism comprises:

a gearbox having a worm wheel;

a worm meshed with the worm wheel to form a worm drive;

a hub coupled to the worm wheel;

a preload cable having a first end attached to the hub and a second end attached to the first end of the tension spring; and a handle coupled to the worm drive.

* * * * *